US005487516A

United States Patent [19]

Murata et al.

[11] Patent Number: 5,487,516

[45] Date of Patent: Jan. 30, 1996

[54] TRAIN CONTROL SYSTEM

[75] Inventors: Satoru Murata; Atsushi Kawabata; Shuuichi Miura; Korefumi Tashiro; Yasuo Morooka; Masakazu Yahiro; Masaki Katahira; Kazuo Kera, all of Hitachi, Japan

[73] Assignee: Hitachi, Ltd., Tokyo, Japan

[21] Appl. No.: 213,358

[22] Filed: Mar. 15, 1994

[30] Foreign Application Priority Data

Mar. 17, 1993 [JP] Japan ..... 5-056750

[51] Int. Cl.[6] ..... B61L 27/00

[52] U.S. Cl. ..... 246/182 C; 246/4

[58] Field of Search ..... 246/182 R, 182 B, 246/182 C, 2 R, 3, 4, 6, 25, 167 R

[56] References Cited

U.S. PATENT DOCUMENTS

| | | | |
|---|---|---|---|
| 4,279,395 | 7/1981 | Boggio et al. | 246/182 R |
| 4,495,578 | 1/1985 | Sibley et al. | 246/182 R |
| 5,239,472 | 8/1993 | Long et al. | 246/182 R |
| 5,340,062 | 8/1994 | Heggestad | 246/182 R |

FOREIGN PATENT DOCUMENTS

| | | | |
|---|---|---|---|
| 0467377 | 1/1992 | European Pat. Off. . | |
| 539885 | 5/1993 | European Pat. Off. | 246/182 R |
| 1605862 | 5/1971 | Germany . | |
| 2149283 | 4/1973 | Germany | 246/182 R |
| 3044502 | 5/1982 | Germany | 246/182 R |
| 3408521 | 9/1985 | Germany . | |
| 48-64604 | 9/1973 | Japan . | |
| 4252769 | 9/1992 | Japan | 246/182 R |
| 4283163 | 10/1992 | Japan | 246/182 R |
| 0516809 | 1/1993 | Japan | 246/182 R |
| 5112243 | 5/1993 | Japan | 246/182 R |
| 5131928 | 5/1993 | Japan | 246/182 R |
| 5221320 | 8/1993 | Japan | 246/182 R |

*Primary Examiner*—Mark T. Le

*Attorney, Agent, or Firm*—Kenyon & Kenyon

[57] ABSTRACT

A train control system includes an equipment for issuing, to a train under control based on a predetermined train schedule, an operational target to be attained in terms of the aimed position, aimed time and aimed speed. Once a target is issued, a possible run region of the train is determined, and another target may be set within the possible run region such that the train is not subjected to the ATC-based speed limitation or the like, thereby minimizing the cause of delay of the train operation.

19 Claims, 18 Drawing Sheets

TRAIN CONTROL SYSTEM

BACKGROUND OF THE INVENTION

This invention relates to a train control system for controlling the operation of trains that run based on a planned schedule.

Conventionally, trains have been run by being dependent on the experience of train drivers. At the departure of one station, the driver is given only information on the scheduled arrival time and departure time of the next station. The driver runs the train by experience in consideration of the load factor, the slope in each railroad section, the speed limit imposed by signals and curves of railroad, the energy conservation, the ride comfort, etc., and uses a marginal time arbitrarily during a run and a stop at the next station until the departure time. If the train operation schedule is disrupted by bad weather or accident, the operation control equipment in the central control office determines a modified schedule and issues an inter-station run time that is based on the modified schedule to the train driver, and the driver runs the train within the modified inter-station run time.

For the security of the train operation, there is used the automatic train control (ATC) system. The ATC system is designed to divide the railroad between stations into multiple sections and impose a speed limit on the rear-running (latter) train depending on the number of free sections left behind the front-running (former) train, i.e., the fewer the number of free sections ahead of a train, the more severe speed limitation is imposed on the train, as described in Japanese patent publication JP-A-48-64604.

Conventionally, the train driver uses a marginal time arbitrarily during the period between stations and does not know the immediate position and speed of the former train. Consequently, the train runs as usual even if the former train reduces the speed due to bad weather or accident, resulting in the application of the ATC-based speed limitation and the incompliance of the specified inter-station run time. Moreover, the speed limitation imposed on one train causes another speed limitation on the latter train, and this adverse effect propagates one after another to exhibit the "accordion phenomenon", resulting in an aggravated disruption of the operation schedule.

During the recovery period of the disrupted schedule through the application of a modified schedule, the train driver who is allowed to use arbitrarily a marginal time included in the modified schedule tends to run the train at the highest-possible speed within the limit with the intention of restoring the train schedule. As a result, the train comes too close to the former train, which often incurs the accordion phenomenon and the retardation of schedule recovery.

The conventional train control scheme is vulnerable in that once the operation of a train is disrupted, it is liable to propagate to the following trains and the operation plan needs to be altered ultimately in many cases. Another problem is a slow recovery to the original schedule during the application of an altered schedule.

SUMMARY OF THE INVENTION

The present invention provides a train control system capable of minimizing the cause of delay of the train operation.

It also provides a train control system capable of restoring the train operation schedule after the occurrence of a delay.

To achieve the above objectives, the inventive train control system includes means for issuing, to a train under control based on a train schedule, an operational target to be attained in terms of the aimed position, aimed time and aimed speed.

To achieve the above second objective, the inventive train control system includes means for issuing, to a front-running (former) and rear-running (latter) trains under control based on a train schedule, operational targets to be attained in terms of the aimed position, aimed time and aimed speed; means of calculating possible run regions of these trains to attain the respective targets; and means of setting a new target within the respective possible run region of one of the former and latter trains upon detecting disruption of target attainment for the latter train.

By providing a train with an operational target in terms of the aimed position, aimed time and aimed speed, a possible run region of the train on the distance-time plane is determined uniquely. Unless there emerges a unfault, disruption of train operation, e.g., the ATC-based speed limit signal, in this run region, or if a target with no likelihood of disruption is set (the latter train can possibly encounter disruption attributable to the maneuver of the former train because only the arrival time is determined as mentioned previously), disruption that would cause delays can virtually be eliminated.

When disruption is detected as a result of calculation of the possible run region from the target, an intermediate target is set within the run region so that a narrowed possible run region is rid of misease, whereby the scheduled train operation can be restored in a minimal time.

DETAILED DESCRIPTION

Initially, the reduction of the train operation interval by application of this invention will be explained with reference to FIG. 2 through FIG. 7.

Figure 2:
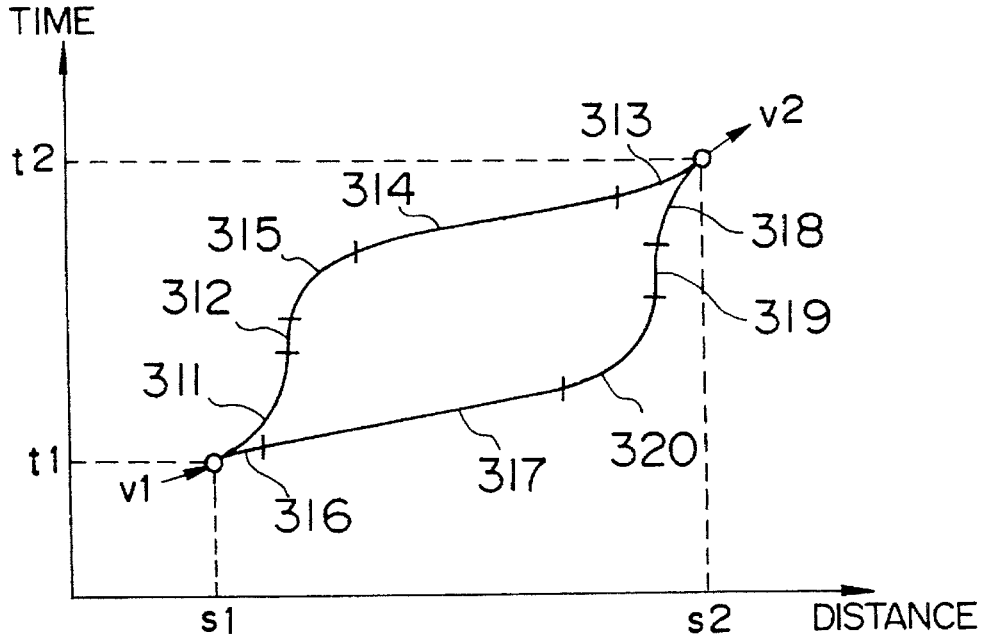
FIG. 2 through FIG. 7 are graphs used to explain the principle of this invention.

FIG. 2 shows the determination of a train existence region on the distance-time plane depending on the operational target (position, time and speed) issued to a train. By setting a pair of targets (position, time, speed) to be (s1, t1, v1) and (s2, t2, v2) for a train as shown in the figure, with the maximum acceleration, maximum deceleration and maximum speed being specific to the train and the railroad conditions (slope, curve, etc.) being specific to the railroad, the train existence region is defined uniquely by the curves on the distance-time plane as shown.

On the upper bound of the region, the train running at the position s1 slows down from the speed v1 to 0 at the maximum deceleration along a curve segment 311, and it is stopping along a line segment 312. The train speeds up from stoppage to the maximum speed at the maximum acceleration along a curve segment 315, keeps the maximum speed along a line segment 314, and slows down to the speed v2 along a curve segment 313. On the lower bound of the region, the train speeds up from the speed v1 to the maximum speed at the maximum acceleration along a curve segment 316, keeps the maximum speed along a line segment 317, and slows down to a stop at the maximum deceleration along a curve segment 320. After the train has stayed stationary along a line segment 319, it speeds up from stoppage to the speed v2 at the maximum acceleration along a curve segment 318. The train existence region is confined in this region.

The train with a current situation (s1, t1, v1) has its existence region defined on the distance-time plane through the specification of its coming situation (s2, t2, v2). By specifying a limited acceleration (or deceleration) at the positions s1 and s2, the train existence region is narrowed.

Figure 3:
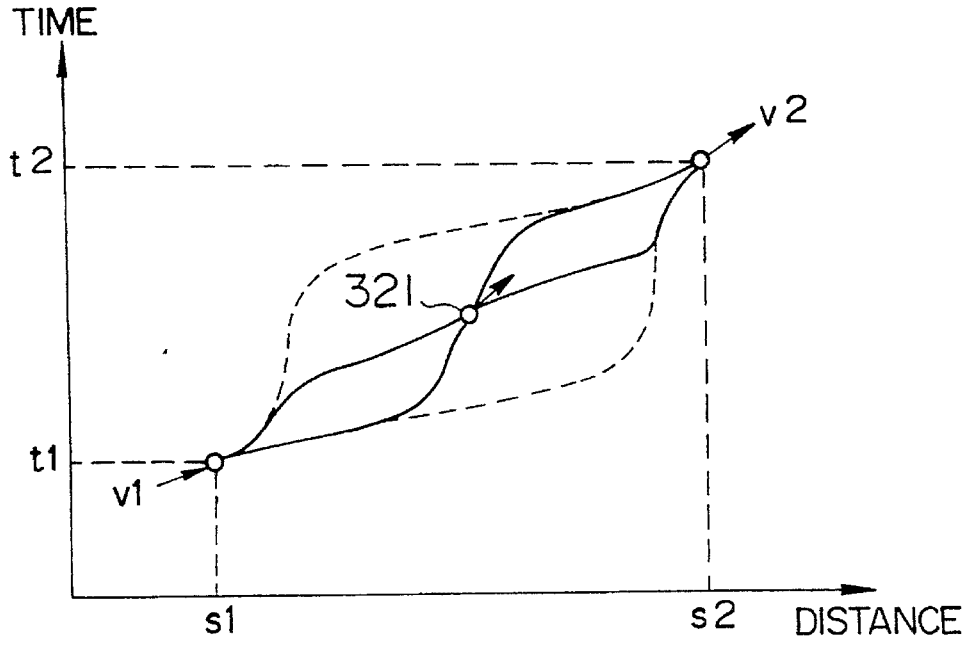

Next, the principle of narrowing the train existence region will be explained with reference to FIG. 3. By adding an intermediate target 321 in the existence region that has been defined by the two targets in FIG. 2, this train existence region (possible run region) is narrowed as shown in FIG. 3.

Figure 4:
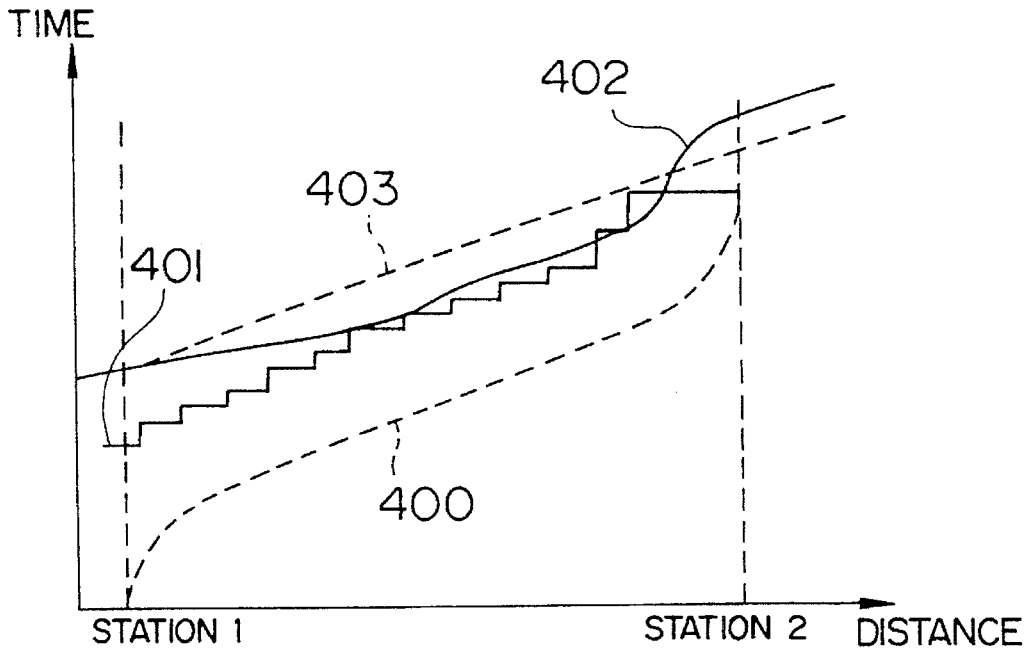

FIG. 4 shows the case of two trains running on the same railroad, in which a train that has started from the station 1 (curve 400) is passed by a latter train (curve 402 or 403) at the station 2. The following explains the optimal running pattern for the trains.

The presence of the former train causes the ATC system to produce a speed limit signal, and if the latter train runs faster than the limited speed, the normal maximum braking (ATC braking) works and the train decelerates down to the limited speed. A stepping line 401 shows the transition of the speed limit signal.

If the latter train that has passed the station 1 runs at a high speed continuously, it will have its running curve in contact with the speed limit signal by coming too close to the former train and will have to slow down by the activation of the ATC brake as shown by the curve 402. On the other hand, if the latter train runs along the curve 403, it can pass the former train at the station 2 smoothly without having the ATC brake activated.

The curve 402 has the passage of the station 2 later than the curve 403 due to the ATC braking, and this excessive time may cause a delay of the train or may retard the recovery of schedule if the train already lags. Moreover, the curve 402 involves an additional acceleration (power running) following the ATC braking, resulting in an increased power consumption and degraded ride comfort. Accordingly, it is highly desirable to run a train so that the ATC braking does not work.

The principle of generating the ideal running pattern 403 based on this invention will be explained with reference to FIG. 5 through FIG. 7.

Figure 5:
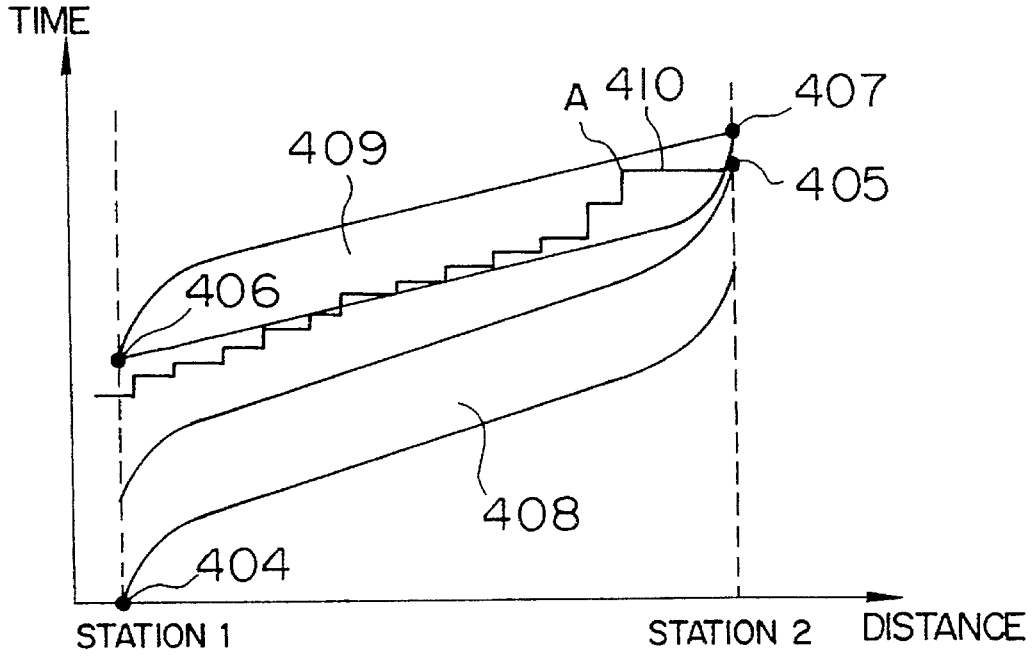

Among targets (position, time and speed) shown in FIG. 5, indicated by 404 is the departure time of the former train at the station 1, 405 is the arrival time of the former train at the station 2, 406 is the passing time of the latter train at the station 1, and 407 is the passing time of the latter train at the station 2. For the targets 404 and 405 of the former train and the targets 406 and 407 of the latter train, the respective possible run regions 408 and 409 are calculated in the same manner as explained with respect to FIG. 2. A stepping line 410 represents the speed limit signal of the worst case when the train runs in the region 408, i.e., when the former train runs along the upper bound of the region 408.

FIG. 5 reveals that if the former and latter trains run independently, there is a possibility of ATC braking of the latter train and it precludes the train from taking the optimal running maneuver. The inventive train control system calculates possible run regions of individual trains thereby to find regions in which the ATC braking possibly takes place (inter-train disruption).

Next, the principle of dissolving the inter-train disruption will be explained with reference to FIG. 6. In the figure, new aimed targets 411 and 412 for the former and latter trains are added to the targets shown in FIG. 5. The preceding regions are reformed to regions 413 and 414 and regions 415 and 416 by the new aimed targets. As a result of the addition of the intermediate aimed target, the possible run region of the former train is narrowed, causing the speed limit signal to move toward the region of the former train, and the possibility of ATC braking of the latter train diminishes. In addition, the point of speed limit signal that is most likely in contact with the running curve of the latter train becomes coincident with the target 412, and the possibility of ATC braking of the latter train further diminishes.

Figure 6:
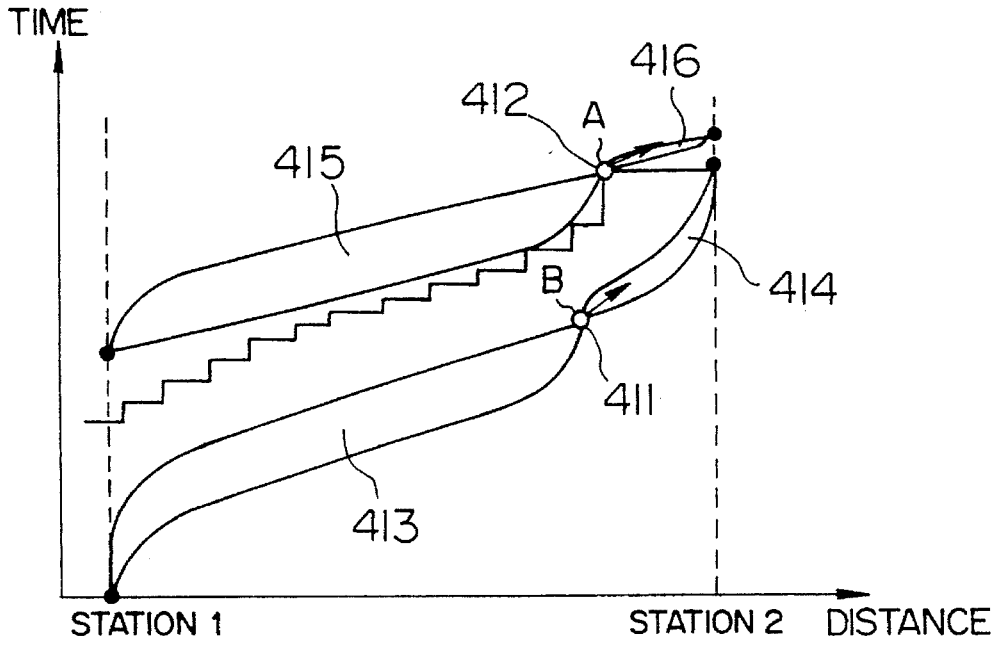
Figure 7:
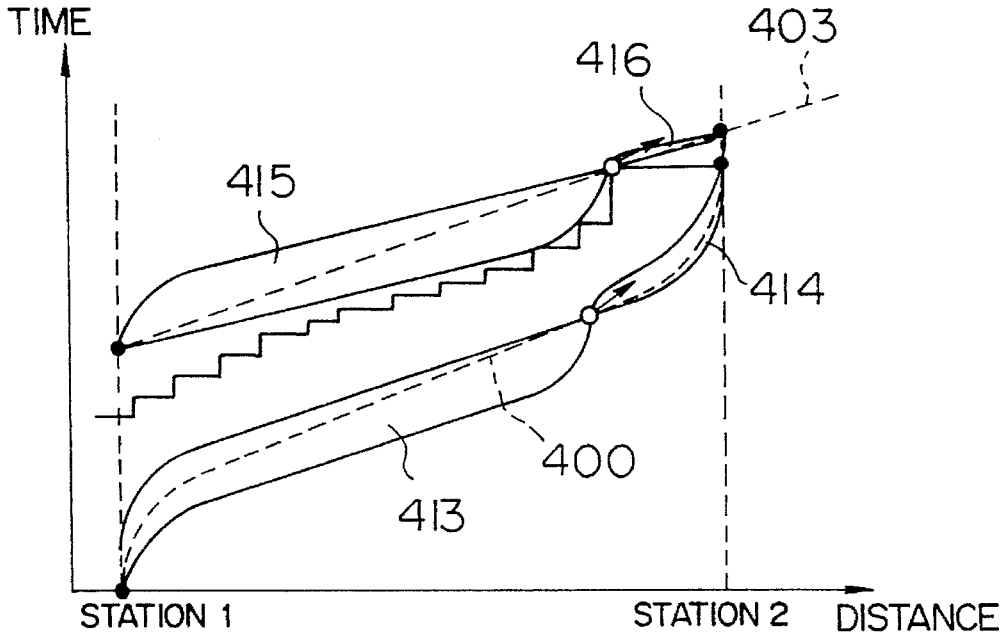

FIG. 7 shows the optimal running pattern, which has been explained on FIG. 4, applied to the distance-time plane of FIG. 6. The figure reveals that the optimal running pattern 400 of FIG. 4 is included in the divided regions 413 and 414, and the optimal running pattern 403 is included in the divided regions 415 and 416. Inter-train disruption does not occur so far as the former and latter trains run within the respective regions.

As described above, the inventive train control system is capable of preventing inter-train disruption through the setting of operational targets (position, time and speed) for individual trains, and further capable of minimizing the cause of disruption through the setting of intermediate targets.

The above-mentioned additional intermediate target must be attainable for the train, and therefore the system implements a process for the judgement of attainability. This process is based on the calculation at each updating of train position information for examining as to whether the train can attain the target when it runs in accordance with the preset optimal running pattern. The process will be explained with reference to FIG. 8 and FIG. 9.

Figure 8:
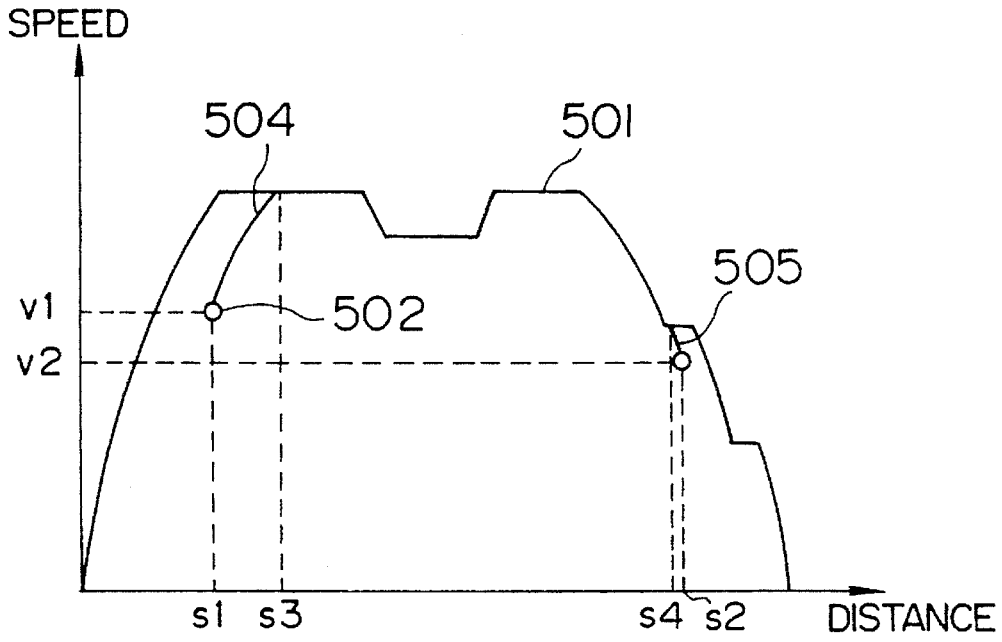
FIG. 8 and FIG. 9 are graphs used to explain the calculation of the value used for the judgement of the attainment of target.

It is assumed that the train with a current situation (s1, t1, v1) is going to run to attain a target (s2, t2, v2). FIG. 8 shows a curve 501 of the top-speed pattern, with a point 502 of the current position s1 and speed v1 and a point 505 of the target position s2 and speed v2 being plotted, on the distance-speed plane. A curve 504 that leads the train from the point 502 (s1, v1) onto the top-speed pattern at the maximum acceleration is calculated from railroad data and train performance data. Similarly, a curve 505 that leads the train from the curve 501 to the target point 502 (s2, v2) at the maximum deceleration is calculated. From the resulting curves 504 and 505, the distance-speed curve 501 of the top-speed pattern and the current train position-speed information, the time t when the target position and speed (s2, v2) are attained in the shortest time is calculated. By comparing the time t with the target time t2, if t is not later than t2, the target is judged to be attainable.

Figure 9:
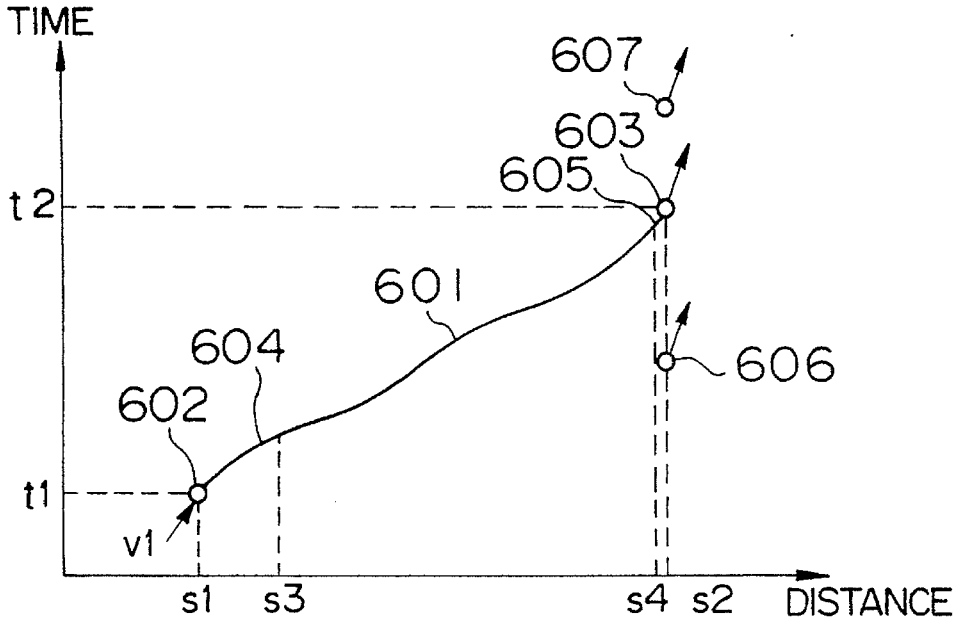

FIG. 9 shows the foregoing affair on the distance-time plane. Indicated by 602 is the train information (s1, t1, v1), 604 is a distance-time curve corresponding to the distance-speed curve 504, 601 is a distance-time curve corresponding to the distance-speed curve 501, and 603 is the target (s2, t, v2) attained in the shortest time. The gradient of arrow represents the speed at that point in FIG. 9. A target at the point 606 (t is not later than t2) is attainable, and a target at the point 607 (t is later than t2) is not attainable.

For the calculation of t, the distance-speed curve and distance-time curve of the top-speed pattern are calculated in advance and memorized, and therefore only the calculation of the curves 504 and 505 is actually carried out. As a result of the calculation, if the target is proved attainable, it is issued to the train, or otherwise another target is set.

Figure 1A:
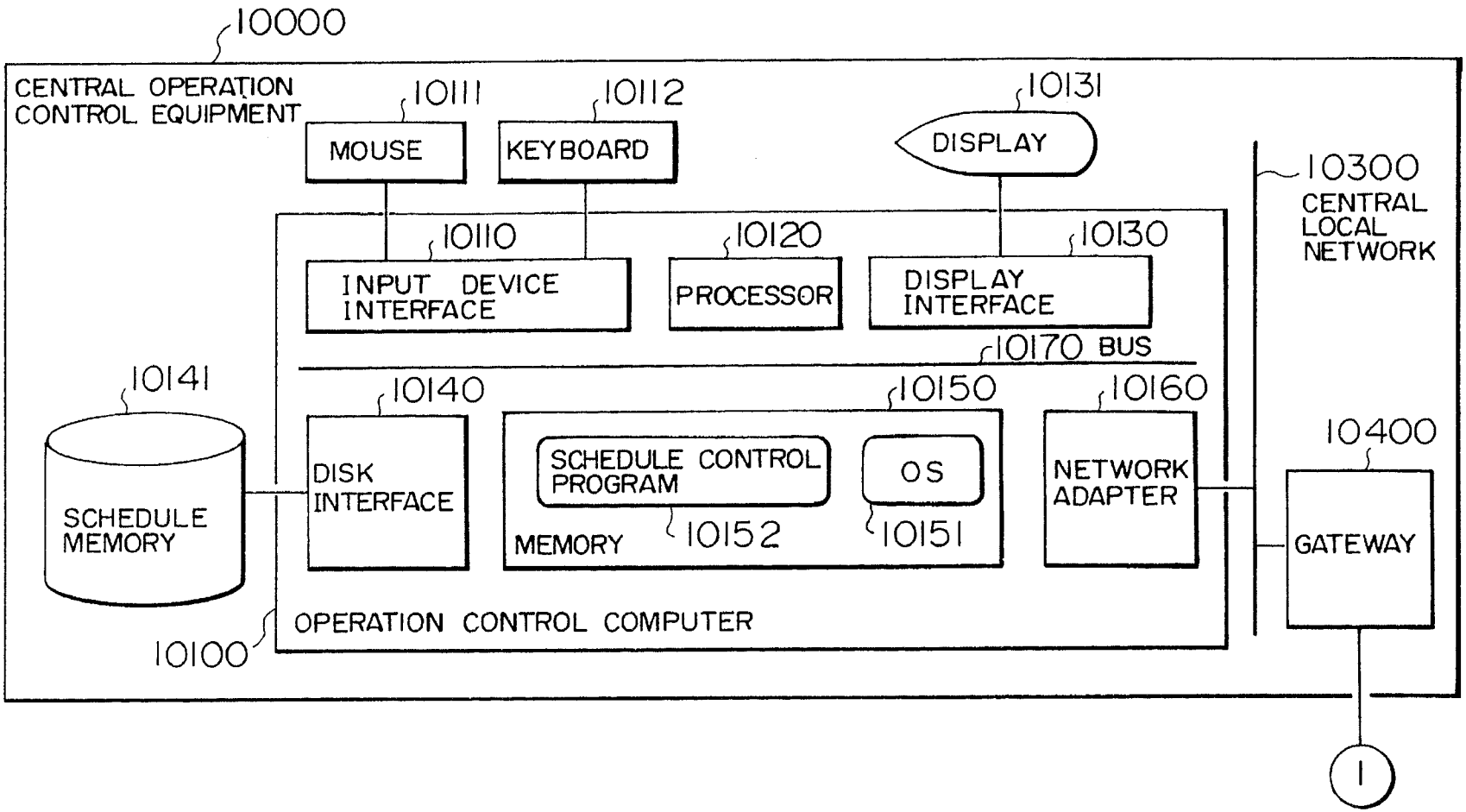
FIGS. 1A, 1B and 1C are divided block diagrams of the train control system based on an embodiment of this invention.
Figure 1B:
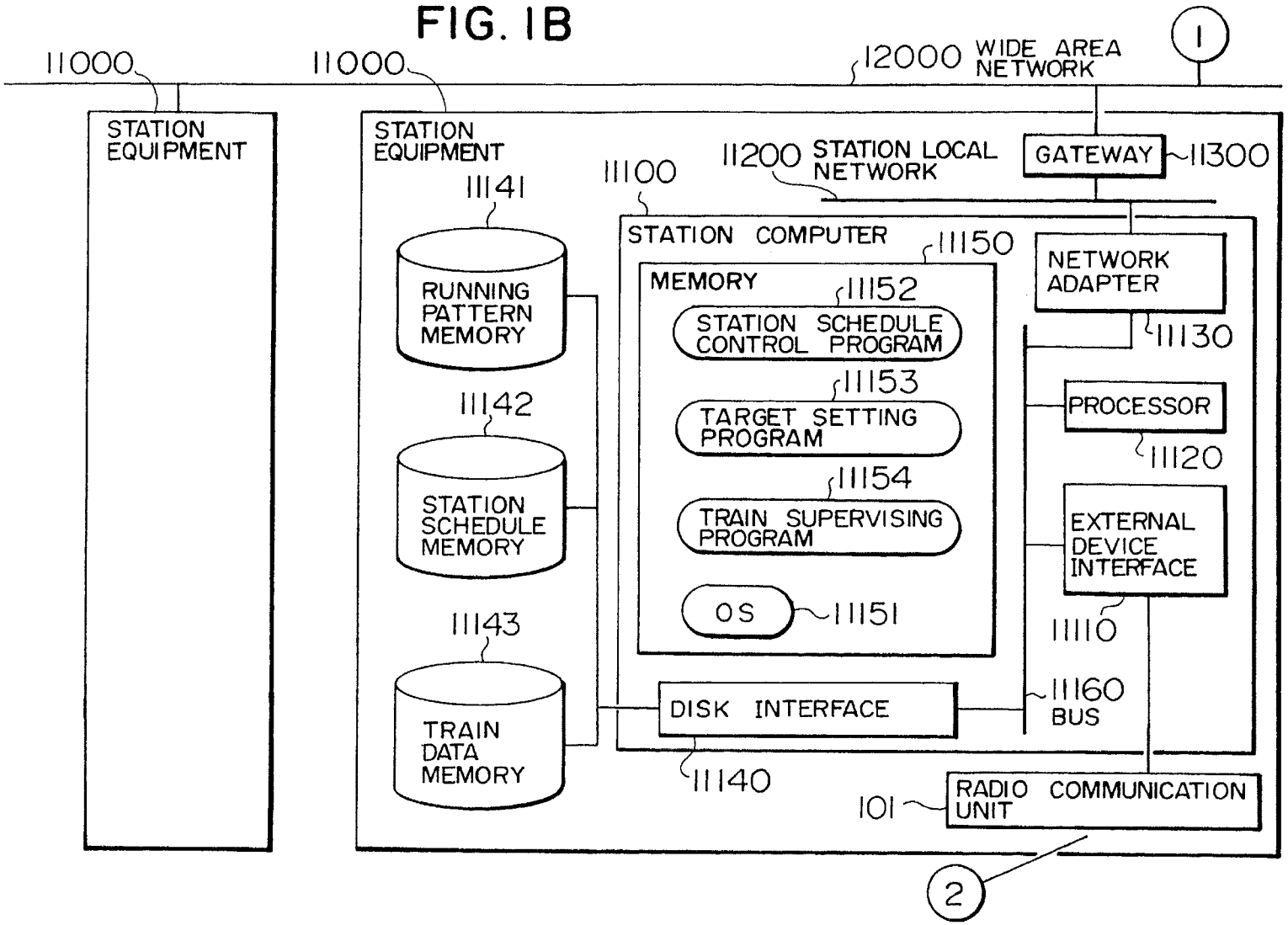
Figure 1C:
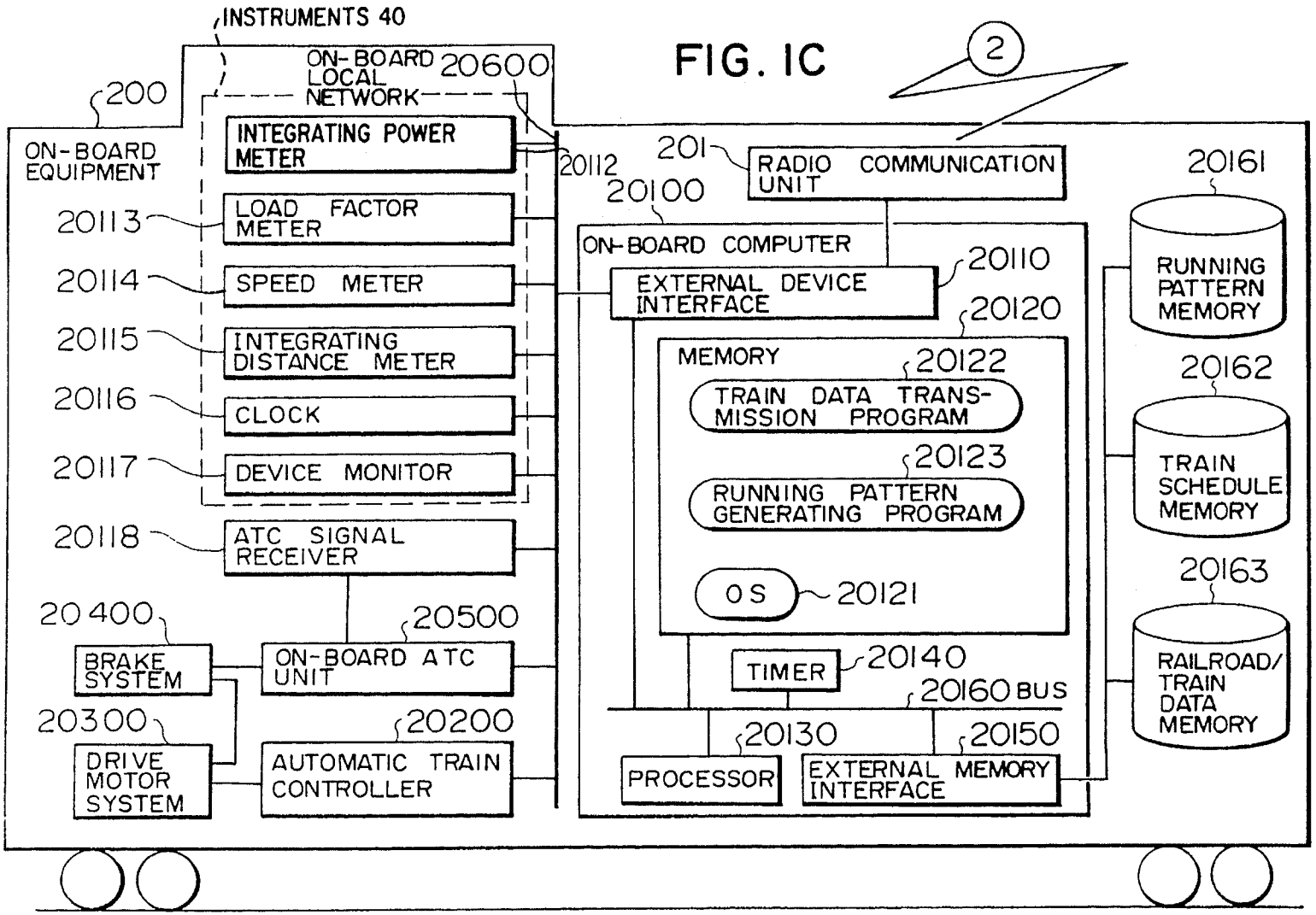

Next, an embodiment of this invention for carrying out the foregoing principle of train control will be explained with reference to FIGS. 1A, 1B and 1C which are divided block diagrams.

A central operation control equipment 10000 and station equipments 11000 are installed on the ground. The central operation control equipment 10000, which creates and alters the schedule of train operation and supervises all trains running on the railroad, includes an operation control computer 10100, which is connected to the station equipments 11000 through a central local network 10300, gateway 10400 and wide area network 12000.

The station equipment 11000 operates in accordance with a station schedule that is based on the train schedule to supervise a train 20 which has departed from the neighboring station and is on the way to that station, and it establishes an operational target for the train 20 based on the station schedule and sends it to the train. A portion of the railroad ranging from the neighboring station to the yard of that station is called "self-station bound".

In the station equipment 11000, a station computer 11100 is connected to the station local network 11200. The station equipment 11000 can transact information with an on-board equipment 200 which is installed on the train by means of radio communication units 101 and 201 of both equipments.

The operation control computer 10100 stores in its memory 10150 an operating system (OS) program 10151 and schedule control program 10152, and a processor 10120 of the computer loads and executes these programs. Connected to the operation control computer 10100 are input devices including a mouse 10111 and a keyboard 10112 by way of an input device interface 10110, a display unit 10131 by way of a display interface 10130, a central local network 10300 by way of a network adapter 10160, and a schedule memory unit 10141 by way of a disk interface 10140.

The schedule control program 10152 functions to display train position information sent from station equipments 11000 on the display unit 10131 and creates altered station schedules for individual stations based on an altered schedule entered by the director through the keyboard and mouse.

In the station equipment 11000, a processor 11120 and memory 11150 are connected with a radio communication unit 11111 by way of an external device interface 11110, a station local network 11200 by way of a network adapter 11130, and a running pattern memory unit 11141, station schedule memory unit 11142 and train data memory unit 11143 by way of a disk interface 11140. The station computer 11100 stores in its memory 11150 an OS program 11151, station schedule control program 11152, target setting program 11153 and train supervising program 11154.

The train supervising program 11154 sends information provided by a train to the schedule control program 10152 of the central operation control equipment 10000, and monitors as to whether the train can attain the operational target. The station schedule control program 11152 receives an altered station schedule from the schedule control program 10153 of the central operation control equipment 10000, saves the altered station schedule, and transfers alteration data to the target setting program 11153. The target setting program 11153 functions to set an operational target, or reset an attainable target by altering the original target in response to a schedule alteration.

The on-board equipment 200 includes an on-board computer 20100, a radio communication unit 201, a running pattern memory unit 20161, a train schedule memory unit 20162, a railroad/train data memory unit 20163, an automatic train controller 20200 in connection with the drive motor system 20300 and brake system 20400, an integrating power meter 20112, a load factor meter 20113, a speed meter 20114, an integrating distance meter 20115, a clock 20116, a device monitor 20117, and an ATC signal receiver 20118.

The on-board computer 20100 includes a memory 20120, a processor 20130, an external device interface 20110, an external memory interface 20150 and a timer 20140 all connected with each other through a bus 20160. The memory 20120 stores an OS program 20121, a train data transmission program 20122 and a running pattern generating program 20123.

The automatic train controller 20200, which is connected to the computer devices through the external device interface 20110, controls the drive motor system and brake system so that the train runs in compliance with the running pattern provided by the running pattern generating program 20123.

The train data transmission program 20122 samples instrument data at a constant interval and sends the data to the train supervising program 11154 of the station equipment 11000. The running pattern generating program 20123 normally functions to generate a running pattern for attaining the standard operational target stored in the train schedule memory unit 20162, and it generates another running pattern for attaining a new target upon receiving it from the target setting program 11153.

Next, the operation of the central operation control equipment 10000, station equipment 11000 and on-board equipment 200 will be explained with reference to FIG. 14 through FIG. 20.

Figure 14:
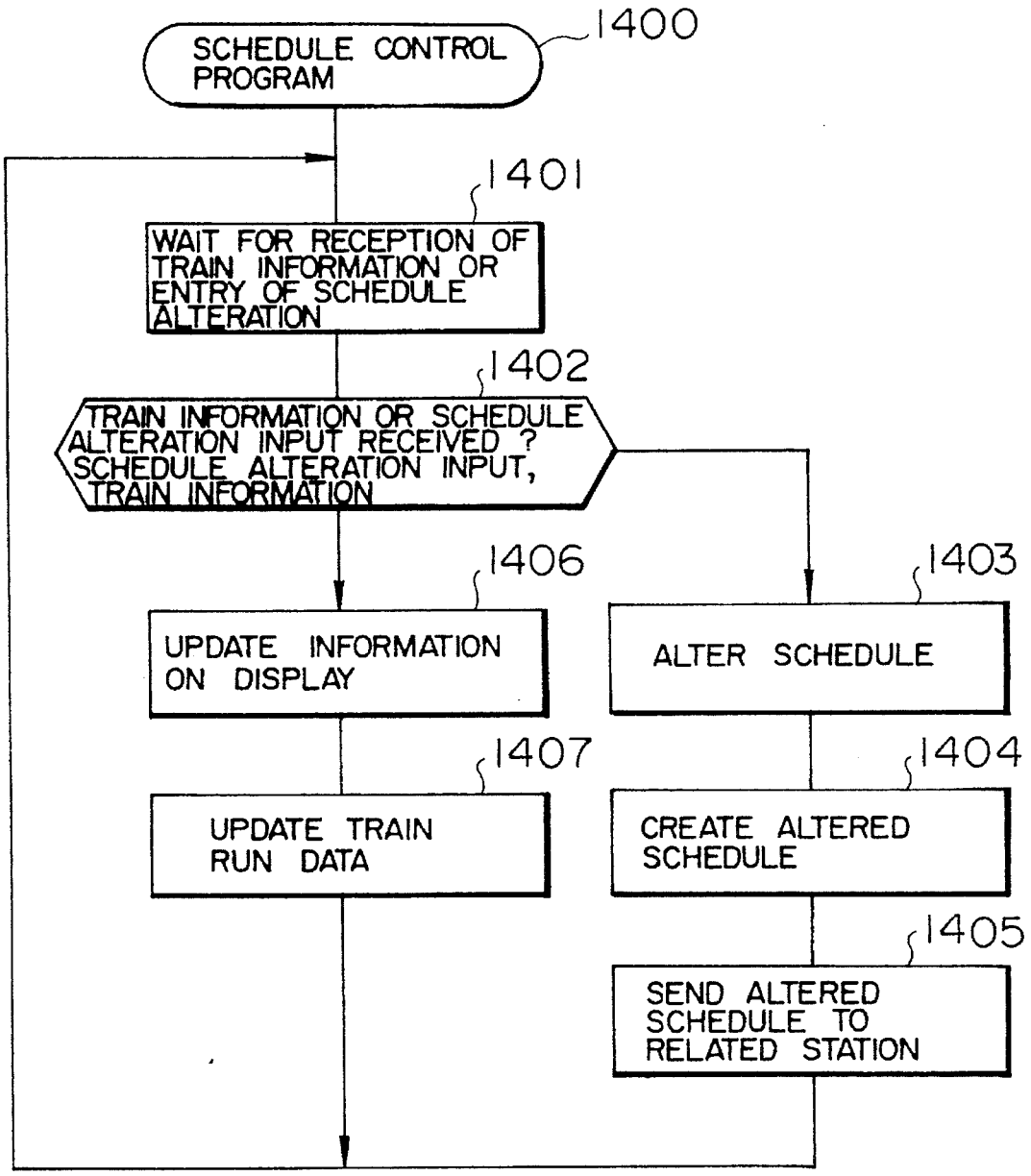
FIG. 14 is a flowchart showing the execution process of the schedule control program.

The schedule control program 10152 of the central operation control equipment 10000 has functions of creating schedules of all trains on the railroad, displaying train tracking information provided by individual station equipments (steps 1406, 1407), and altering the schedules in response to the adjustment of train operation caused by a delay (1402–1405), as shown in FIG. 14. The alteration of schedule takes place following the adjustment of train operation by the director who may cancel the operation of some trains, alter the passing station for some trains and alter the departure time of some trains with the intention of restoring the original schedule in question at the occurrence of a delay that disrupts the planned schedule. The schedule control program 10152 transfers the train operation schedule including altered portions to the station schedule control program 11152 of each station equipment.

The station schedule control program 11152 of each station equipment has functions of storing data of the train number, arrival time, stop/pass mode, departure time and standard target of each train and transferring the status information of each train to the target setting program 11153. The program makes reference to stored information of speed limits at predetermined positions within the yard depending on the stop/pass mode of each train. In case the schedule has been altered, the program stores the altered schedule and updates the target setting program 11153 (see FIG. 20, steps 2200–2203).

The target setting program 11153 fetches data, which has been stored by the station schedule control program 11152, and creates an operational target for a train under control. The target is basically the standard target stored by the station schedule control program 11152, i.e., position, time and speed at the self station for the train that is going to stop or pass. Practically, however, a position immediately before the station yard is set as the target position to avoid a tight running condition due to a fixed braking and passing time lengths (standard yard demand time) required in the station yard where a number of switches and curves exist generally. Namely, a standard target time is determined by subtracting the standard yard demand time from the scheduled arrival time or passing time and a standard target speed is determined from the limited speed imposed on the switch or yard entry.

The standard yard demand time is determined among the shortest demand time of the case of entry to the switch or yard for stopping or passing by application of the highest limited speed and the demand time of the case of entry for stopping or passing by application of the standard entry speed, and it is stored for each case of the type of train, stop/pass mode, track number and entry position. The standard yard demand time is also calculated in the case of schedule alteration based on the altered schedule, standard demand time and standard entry speed.

Figure 15:
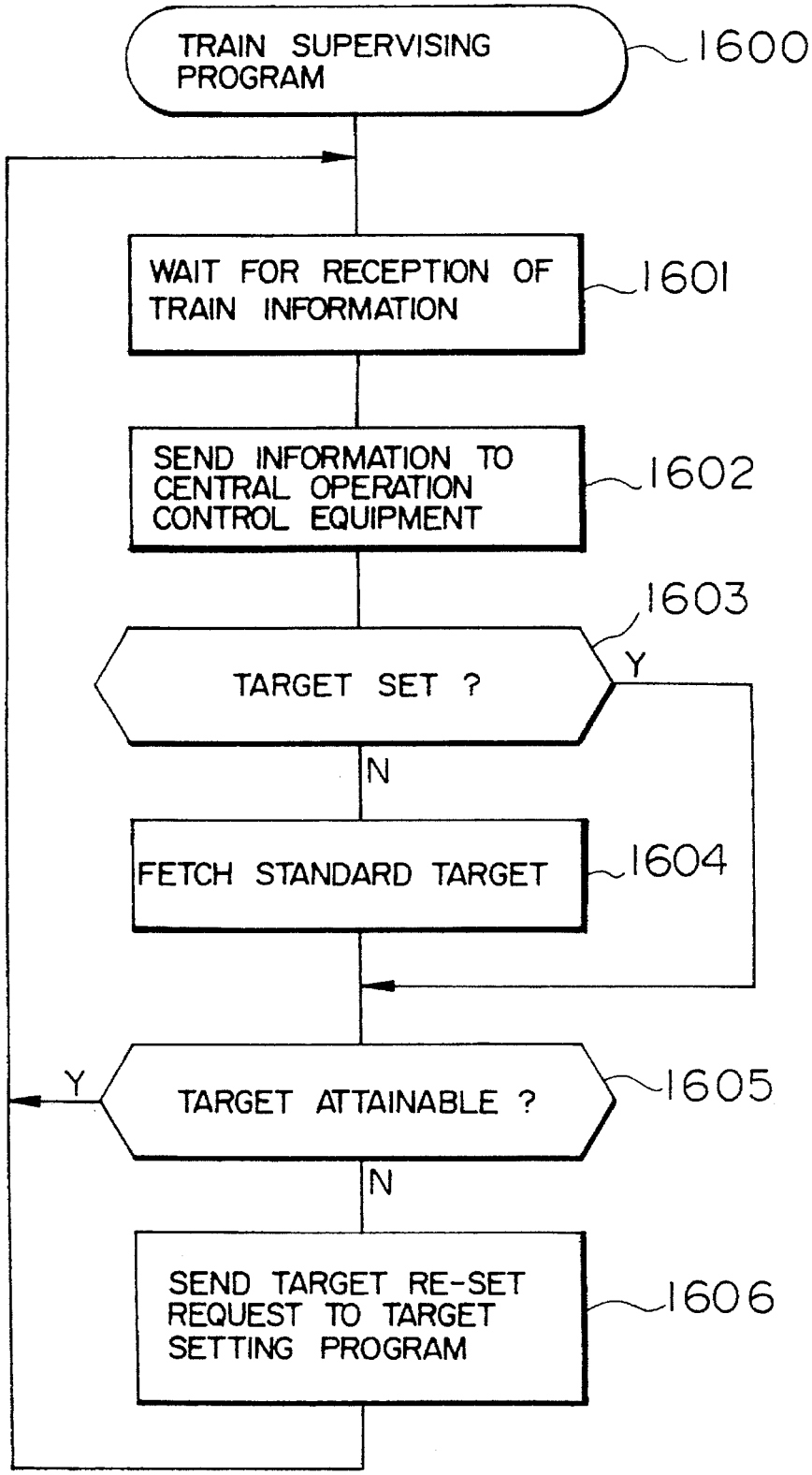
FIG. 15 is a flowchart showing the execution process of the train supervising program.

The standard target created as described above is delivered to the train supervising program 11154 (FIG. 15, step 1606), which based on the foregoing principle examines whether the target is legitimate, i.e., attainable for the train under control (FIG. 15, step 1606).

Figure 16:
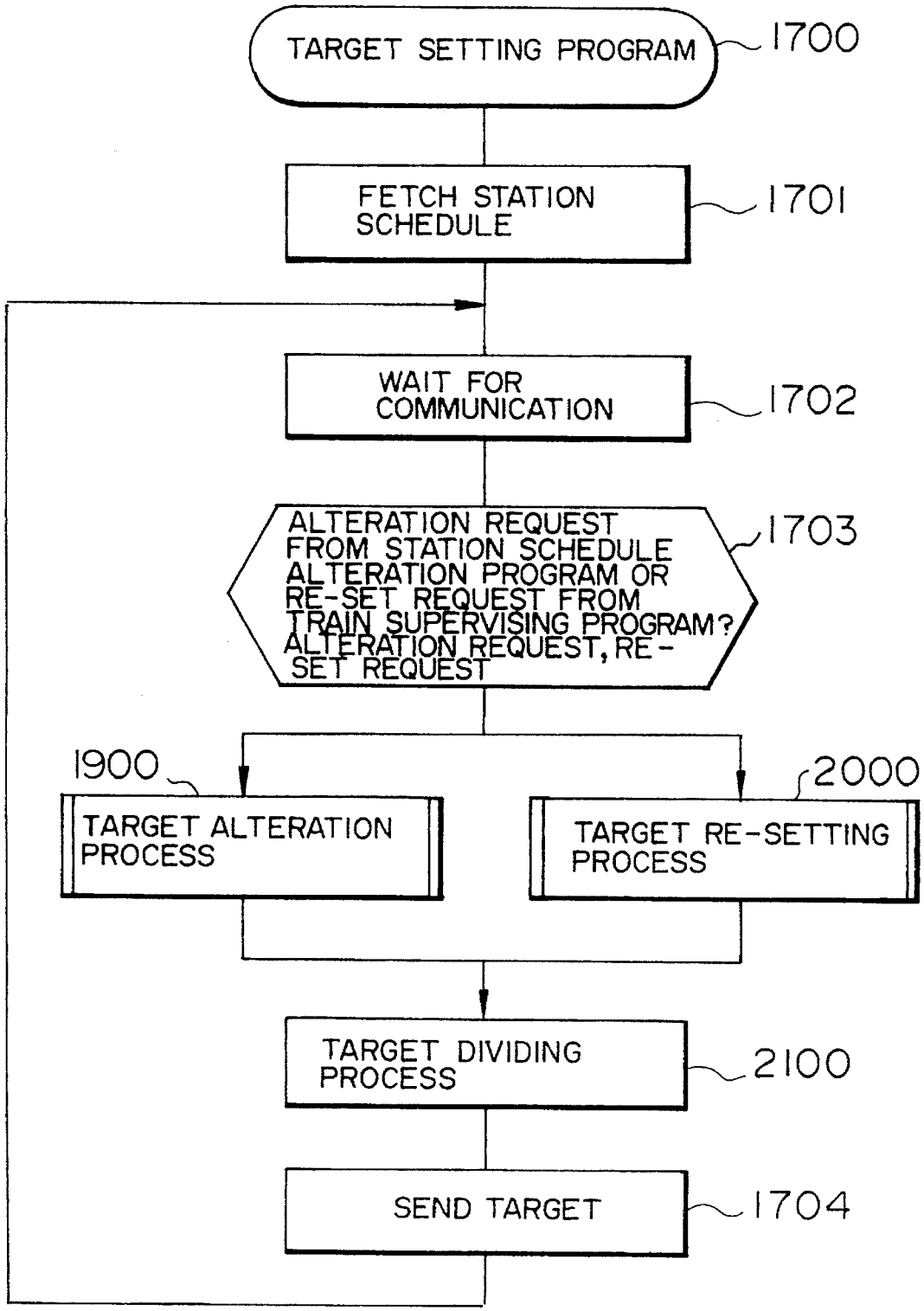
FIG. 16 is a flowchart showing the execution process of the target setting program.
Figure 17:
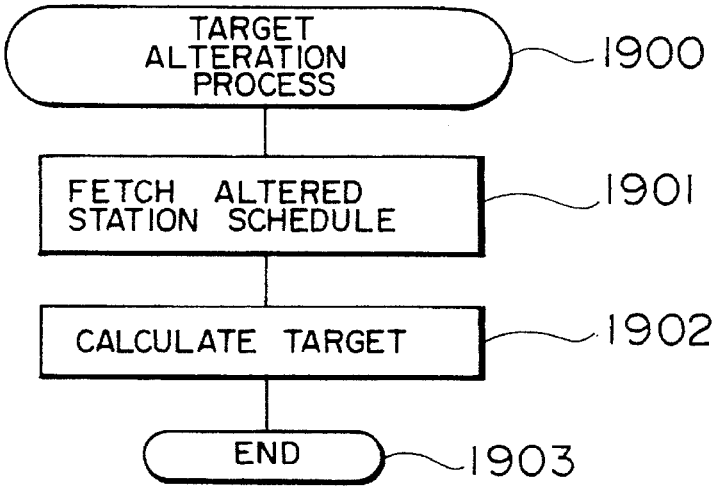
FIG. 17 is a flowchart showing the target alteration process.
Figure 18:
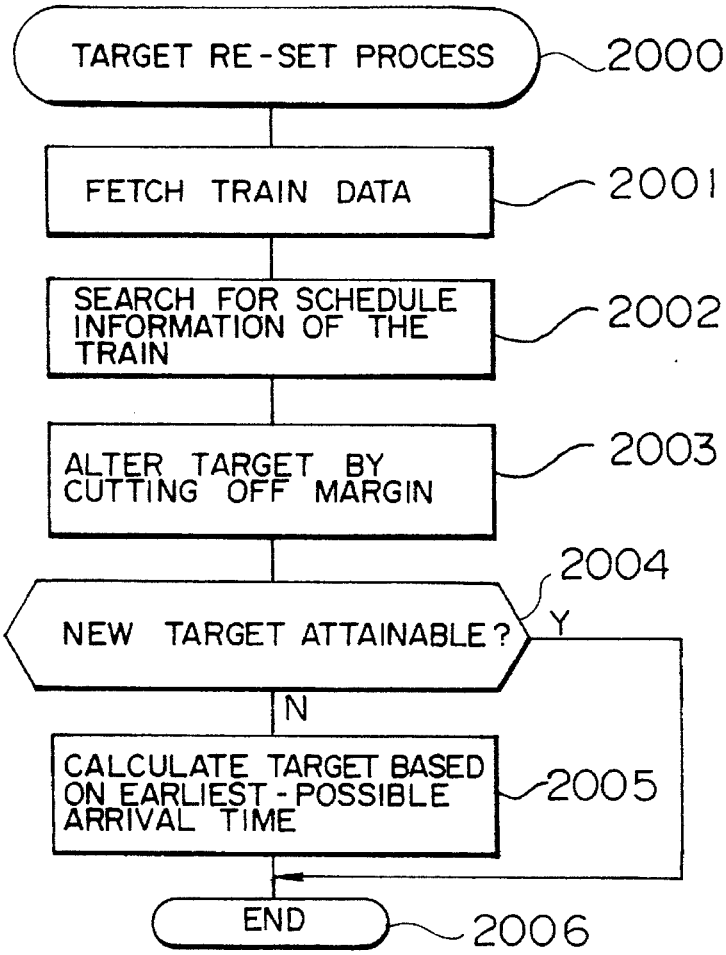
FIG. 18 is a flowchart showing the target re-setting process.

If the target is proved to be attainable, the target setting program 11153 examines a possible inter-train disruption (FIG. 16, step 2100). The word disruption signifies here the ATC or ATC-based speed limitation imposed on the latter train as mentioned previously. The examination of disruption is based on the ATC speed limit signal that is produced and delivered to each block section depending on the running of the former train. Actually, the speed limit signal is calculated from stored data of block sections and the slowest possible running pattern of the former train. The judgement of disruption is made by referencing the speed limit signal and the existence region of the latter train. If there is no possible disruption detected, the generated standard target is transmitted to the on-board equipment 200 (FIG. 15, step 1704). The operation of the on-board equipment 200 will be explained later.

The standard target can be adopted as a train operational target with virtually no problem. However, in the case of the occurrence of a delay or the schedule alteration caused by the adjustment of train operation or the like, the target can longer maintain its legitimacy and the latter train will encounter disruption. Misease may occur during the train operation under the planed schedule without a delay, and the treatment of such cases will be explained in the following.

When the train supervising program 11154 has detected that the train cannot attain the target, another target is set. This case will be explained on the flowchart of FIG. 18. The target time and speed are originally set to have some margins, and accordingly an attainable target is reset by closing up the target time or raising the target speed (step 2003). The target setting program examines whether the train can attain the new target (step 2004). If the target is found still unattainable, the program sets the time and speed at the entry to the switch or yard the assumption that the train runs as fast as possible (step 2005). This is the case of the surrender to the delay even as a result of the establishment of an attainable target, causing another delay of the following trains one after another on the whole railroad.

Figure 19:
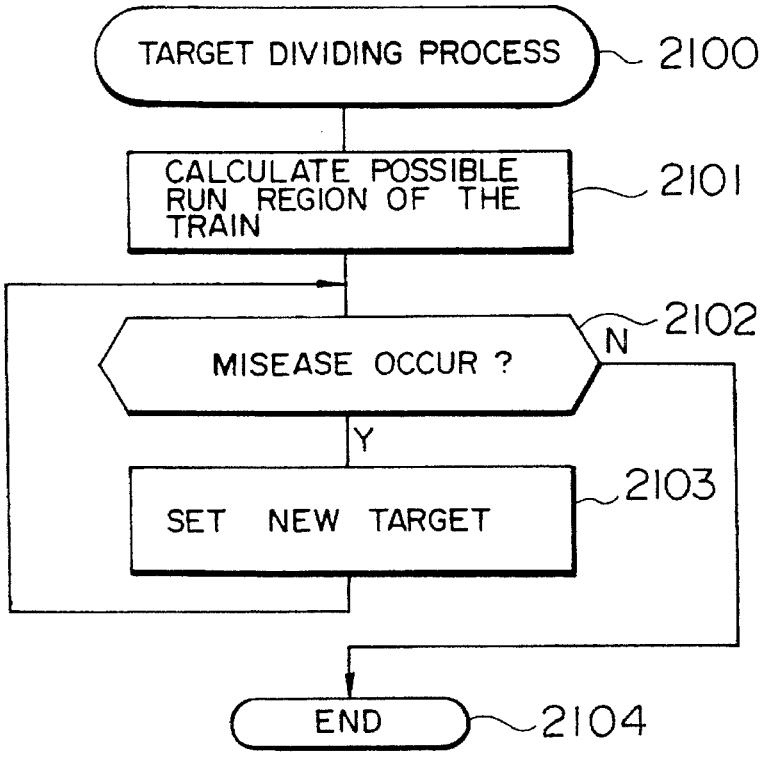
FIG. 19 is a flowchart showing the target dividing process.
Figure 20:
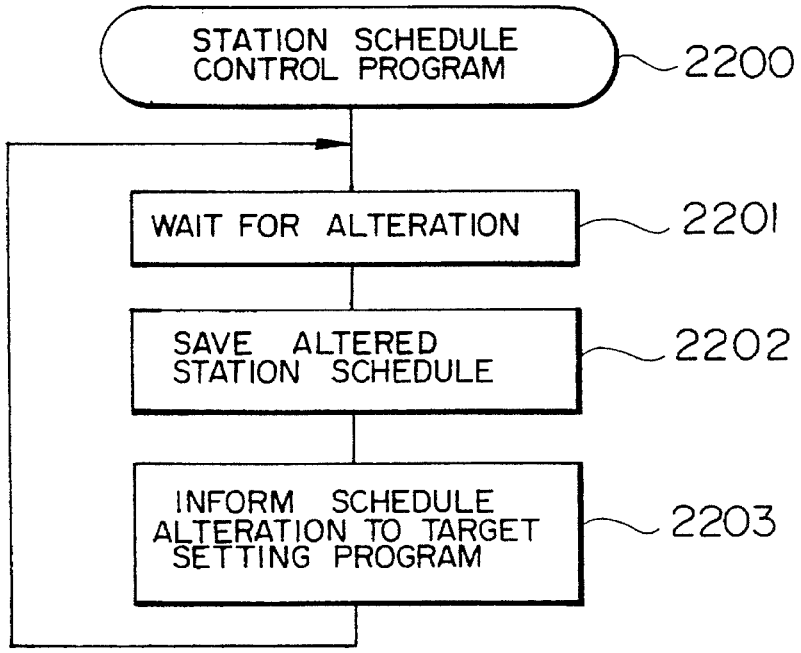
FIG. 20 is a flowchart showing the execution process of the station schedule control program.

In coping with this matter, an intermediate target that can avoid disruption is set based on the principle explained previously on FIGS. 6 and 7 (FIG. 19, 2103). The intermediate target is set within the train existence region that is derived from the final target as mentioned previously and the legitimacy thereof is retained. A conceivable new target is the mid position between the two stations, the mid time between the time points at the stations and the mid speed between the speeds at the stations. The existence regions of the former and latter trains are narrowed by the new target, and the disruption will be dissolved. If the disruption is still undissolved by the application of the new target (FIG. 19, step 2102), further new targets are added one after another (FIG. 19, 2103), and ultimately the disruption will be dissolved. These intermediate targets, however may not be proper.

An embodiment of calculating a proper intermediate target will be explained with reference to FIG. 5 and FIG. 6. In FIG. 5, a stepping line 410 represents the speed limit signal issued to the latter train, and each transition of signal corresponds to the border of block sections. In the case of a possible disruption encountered by the latter train as shown in FIG. 5, which may be avoided depending on the maneuver of the latter train, an intermediate target of the latter train is first determined. The most possible disruption of the latter train will occur in the block section immediately before the station 2 (with the entry point A of the block section on the speed limit signal line closest to the maximum speed pattern of the latter train), and point A is determined to be a new target for the latter train.

The new intermediate target of the latter train is examined for possible disruption before evaluating the intermediate target of the former train. If it is proved to be admissible, the latter train is given the intermediate target and the final target at the station 2 and the former train is given the target at the station 2. Otherwise, if the latter train cannot clear the disruption at the intermediate target as a result of the examination, an intermediate target of the former train is calculated. By setting an intermediate target for the former train, the speed limit signal falls in its entirety as mentioned previously, i.e., the latter train has its imposed speed limit signal raised relatively.

FIG. 6 reveals that the latter train has its possible disruption dissolved in the block section between the point A and station 2 by being given the target at point A. It is uncertain, however, whether the latter train is free from disruption in block sections between the station 1 and point A (the figure shows the case of cleared disruption). On this account, according to this embodiment, an intermediate target B is set at the entry of the block section that is one section back from the point A. Once the target position is determined, the target time is evaluated from the distance-time curve, and conceivably a target speed is set to be the average speed of the top and bottom speed patterns from the intermediate target.

If disruption is not still cleared, a further intermediate target is set for the latter train at a point back from the point B nearer to the station 1 in the same manner as explained above. Namely, intermediate targets are set backward from the block section of station 2 alternately for both trains by beginning with the latter train. Consequently, optimal intermediate targets are obtained at a smaller number of calculating operations as compared with the manner of simply setting an intermediate target at the middle of stations mentioned previously.

The calculated target is transmitted to the on-board equipment 200 by way of the transmission means. The following explains the operation of the on-board equipment that has received the target.

Before the train starts running, the running pattern generating program 20123 of the on-board computer 20100 which is installed in the on-board equipment 200 generates a running pattern of the train for attaining the target that is read out of the train schedule memory unit 20162, and delivers the resulting running pattern to the automatic train controller 20200. The train data transmission program 20122 of the on-board equipment 200 samples at a certain interval train information including at least the position and speed among the time, position and speed measured by the instruments 40, and delivers the information to the train supervising program 11154. The train supervising program 11154 transfers the train information to the central supervising program, and the schedule control program 10152 displays the train information on the display unit 10131.

Generation of a running pattern will be explained with reference to FIG. 10 through FIG. 13. on receiving a target, the running pattern generating program 20123 on the train generates a running pattern for the target. The given target is point information in terms of the position, time and speed, and it needs to be converted into line information on the distance-time plane so that the automatic train controller 20200 implements the feedback control.

Figure 10:
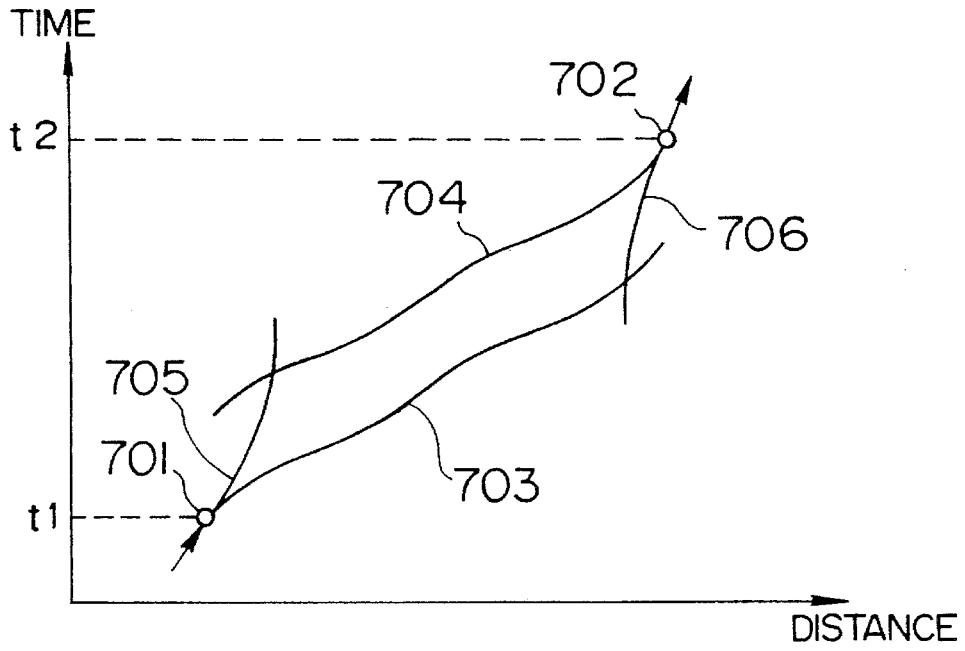
FIG. 10 is a graph used to explain the calculation of the running pattern from the target.

FIG. 10 explains the determination of a train existence region from two given targets 701 and 702 based on the principle that has been explained on FIGS. 7 and 8. Initially, a running curve 703 that connects the maximum speed pattern to the target 701 and a running curve 704 that connects the maximum speed pattern to the target 702 are obtained. Subsequently, a running curve 705 of the maximum deceleration from the target 701 and a running curve 706 of the maximum acceleration to the target 702 are obtained, and consequently a train existence region as shown in the figure is determined.

The actual running pattern between these targets is determined by calculating a curve based on the interpolation of these curves. A curve that links the curves 704 and 705 will be called curve 707, and a curve that links the curves 703 and 706 will be called curve 708.

Figure 11:
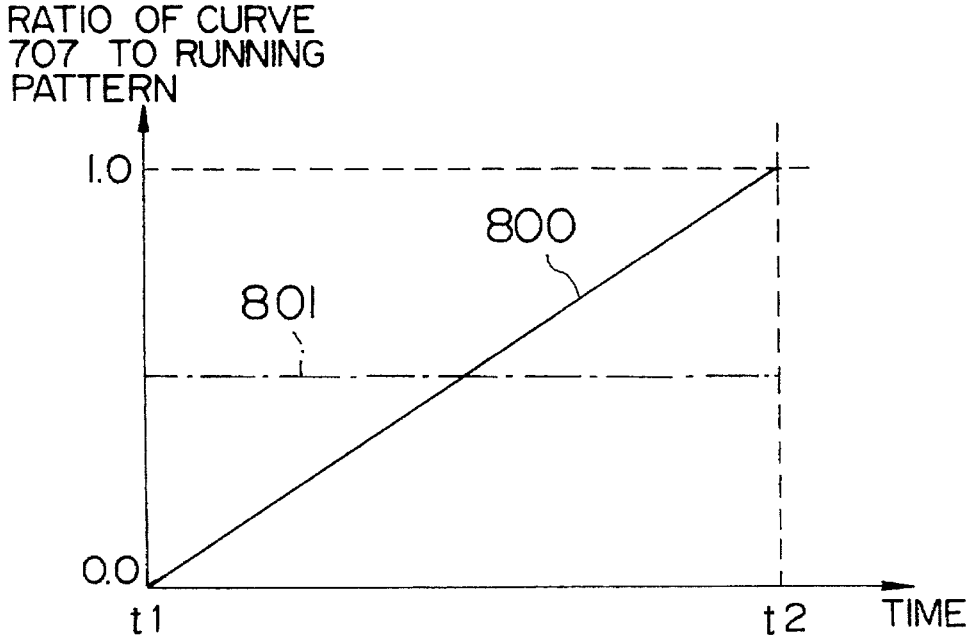
FIG. 11 is a graph used to explain the ratio used for the calculation of the running pattern.

FIG. 11 shows interpolation functions used in this embodiment, in which the ratio of the distance at time t on the curve 707 to the distance at time t on the curve 708 is plotted along the vertical axis against the time on the horizontal axis. Two interpolation functions f(t) 800 and g(t) 801 are shown in the figure.

Figure 12:
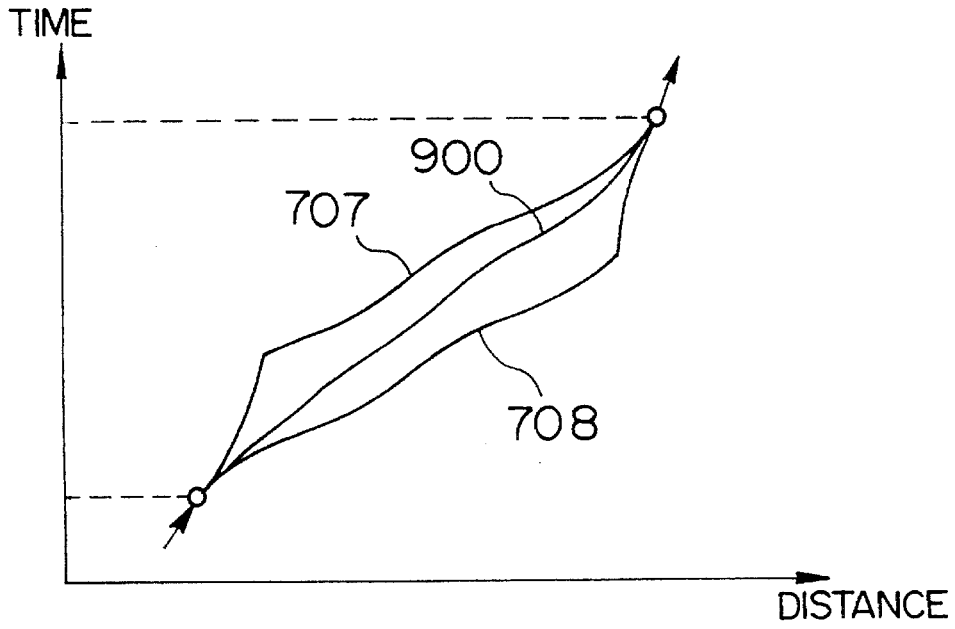
FIG. 12 and FIG. 13 are graphs showing the calculated running patterns.
Figure 13:
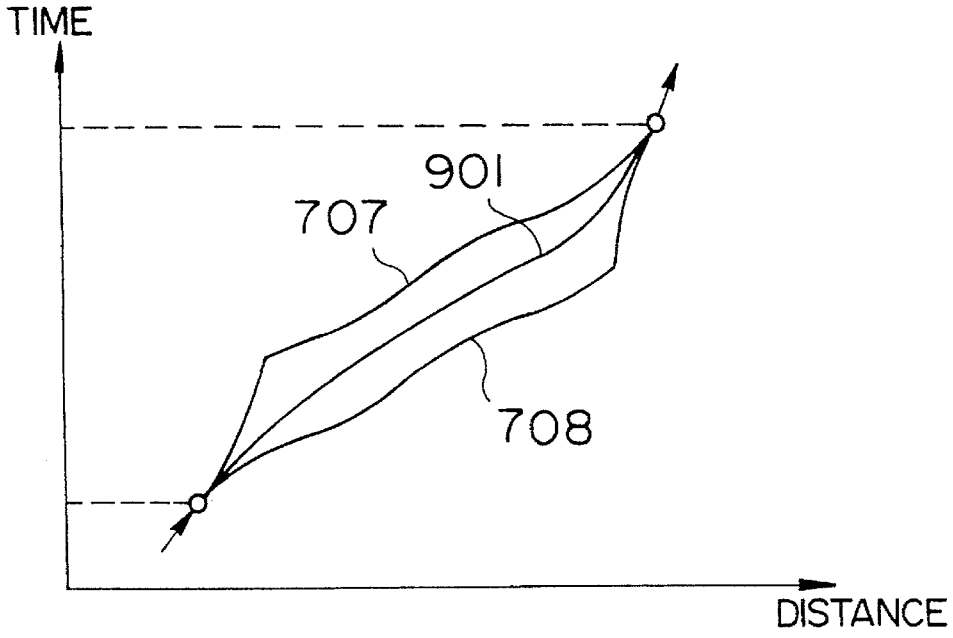

FIG. 12 and FIG. 13 show running patterns created based on these interpolation functions. In FIG. 12, a curve 900 is the running pattern calculated based on the interpolation function f(t) as: (distance at time t on curve 900)=f×(distance at time t on curve 707)+ (1−f)×(distance at time t on curve 708). In FIG. 13, a curve 901 is the running pattern calculated based on the interpolation function g(t) as: (distance at time t on curve 901)=g ×(distance at time t on curve 707)+ (1−g)×(distance at time t on curve 708).

An approximate power consumption is calculated for these running patterns, and one of them with a smaller power consumption is selected. Alternatively, a running pattern with a smaller variation of acceleration is selected in pursuit of ride comfort. It is also possible to select a running pattern based on the power conservation in the morning rush hour time band, and to select a running pattern based on the ride comfort in the noonday relaxing time band.

Besides the use of these two interpolation functions, other practical running patterns can be designed provided that the values of interpolation functions do not decrease during the period between time points t1 and t2. Besides the interpolation of distances at a same time point in the above embodiment, time points at a same distance may be interpolated. Running patterns may be created in arbitrary manners other than those mentioned above, provided that a final running pattern is established within the possible run region of the train.

Figure 21:
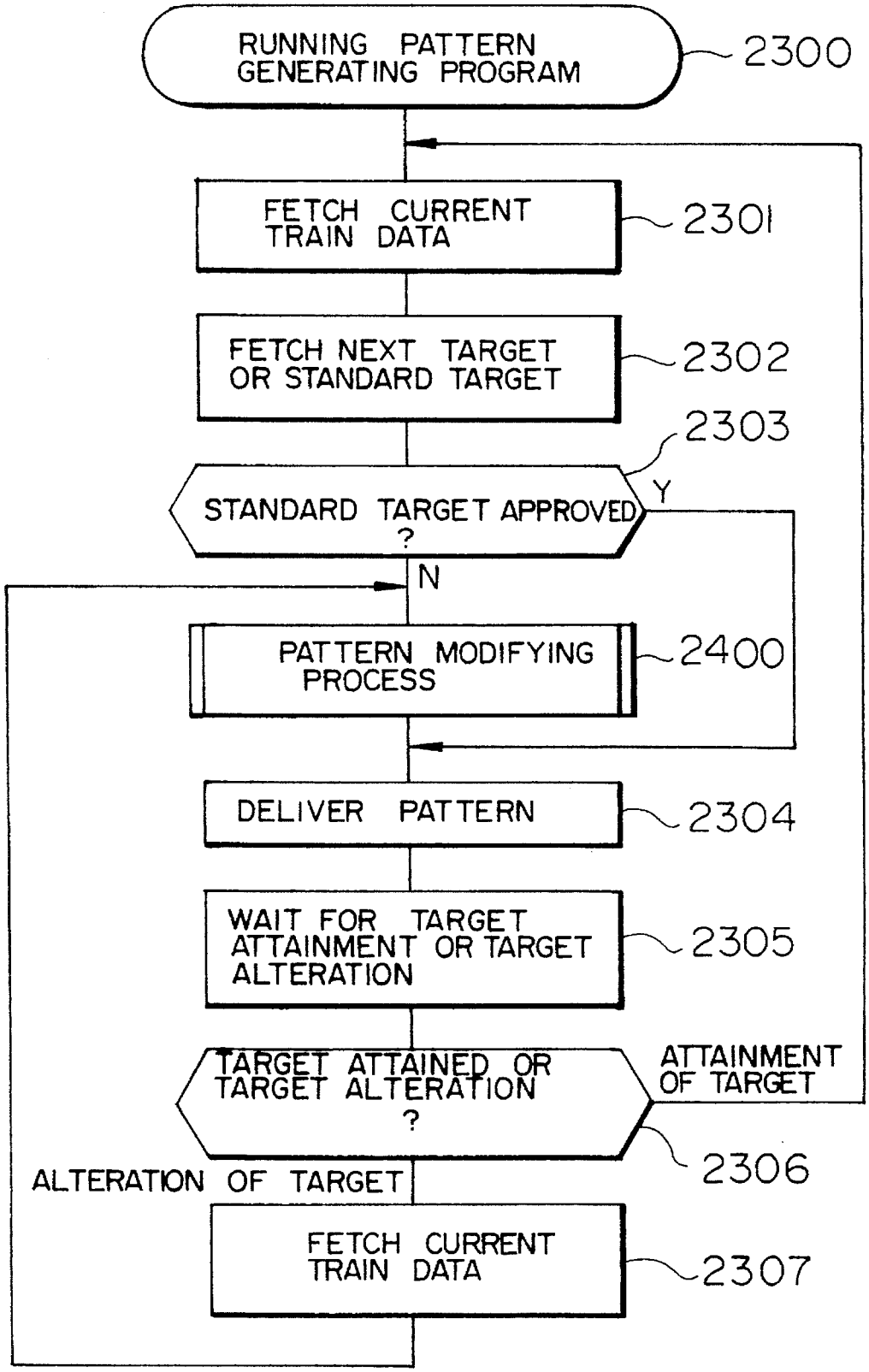
FIG. 21 is a flowchart showing the execution process of the running pattern generation program.

FIG. 21 is the flowchart of running pattern generation. The running pattern generating program 20123 initially fetches the train information (step 2301) of the self train, fetches a target to be attained next from the train schedule memory unit 20162 and a standard running pattern (a running pattern created in advance for the standard target) from the running pattern memory unit 20161 (step 2302). Next, the program examines whether the train in the current situation can attain the target by use of the standard running pattern (step 2303). If the standard running pattern is proved to attain the target, it is brought into effect (step 2304), or otherwise it is rendered the modifying process (step 2400) and the modified running pattern is brought into effect (step 2304). After that, the program waits for the issuance of a new target from the station equipment or the attainment of the target (step 2305). On receiving a new target from the target setting program 11153 of the station equipment 11000, the program fetches the train information (step 2307) and returns to the pattern modifying process (step 2400). On detecting the attainment of target, the program returns to the fetching of train information (step 2301).

Figure 22:
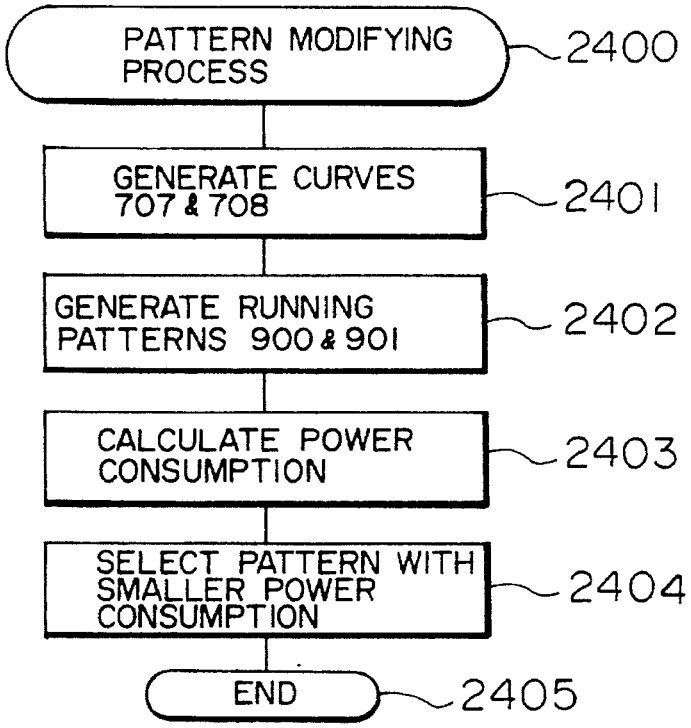
FIG. 22 is a flowchart showing the pattern modification process.

FIG. 22 is the flowchart of the pattern modifying process 2400. In the process, the program generates the above-mentioned curves 707 and 708 (step 2401), calculates the curves 900 and 901 based on prescribed interpolation functions (step 2402), and finally determines a running pattern in consideration of the power consumption and ride comfort (step 2403).

Figure 23:
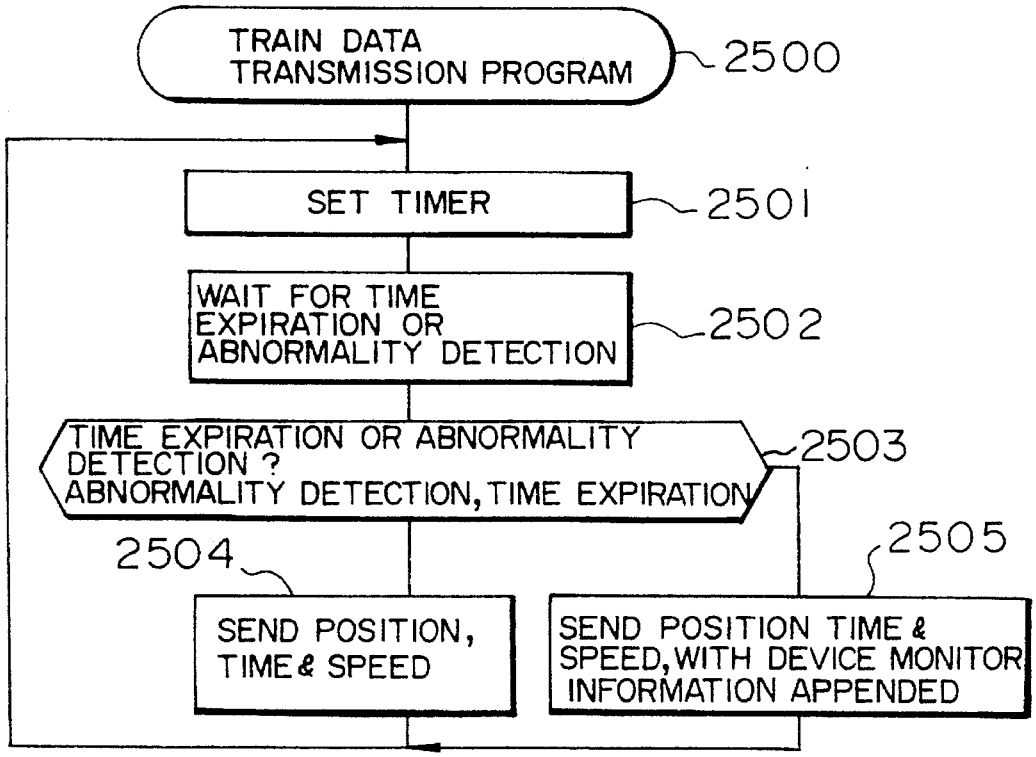
FIG. 23 is a flowchart showing the execution process of the train schedule transmission program.

FIG. 23 is the flowchart of the process of the train data transmission program 20122. The program initially sets a timer 20140 (step 2501), and thereafter waits for the time expiration or the entry of a device abnormality signal (step 2502). In response to the time expiration, the program sends the train information including the train speed, position and time to the train supervising program 11154 of the station equipment 11000 (step 2504), and returns to the setting of the timer (step 2501). In response to the reception of a device abnormality signal, the program sends the train information including the device monitor data, train speed, position and time to the train supervising program 11154 of the station equipment 11000 (step 2505), and returns to the setting of the timer (step 2501).

The foregoing embodiment is capable of carrying out the train control that is free from disruption through the issuance of the operational target in terms of the train speed, position and time to the train.

However, the automatic train controller to which the foregoing embodiment is applied is not yet totally prevailing in reality. The following describes with reference to FIG. 24 through FIG. 26 another embodiment of this invention for carrying out the inventive principle as an operation support system.

Figure 24:
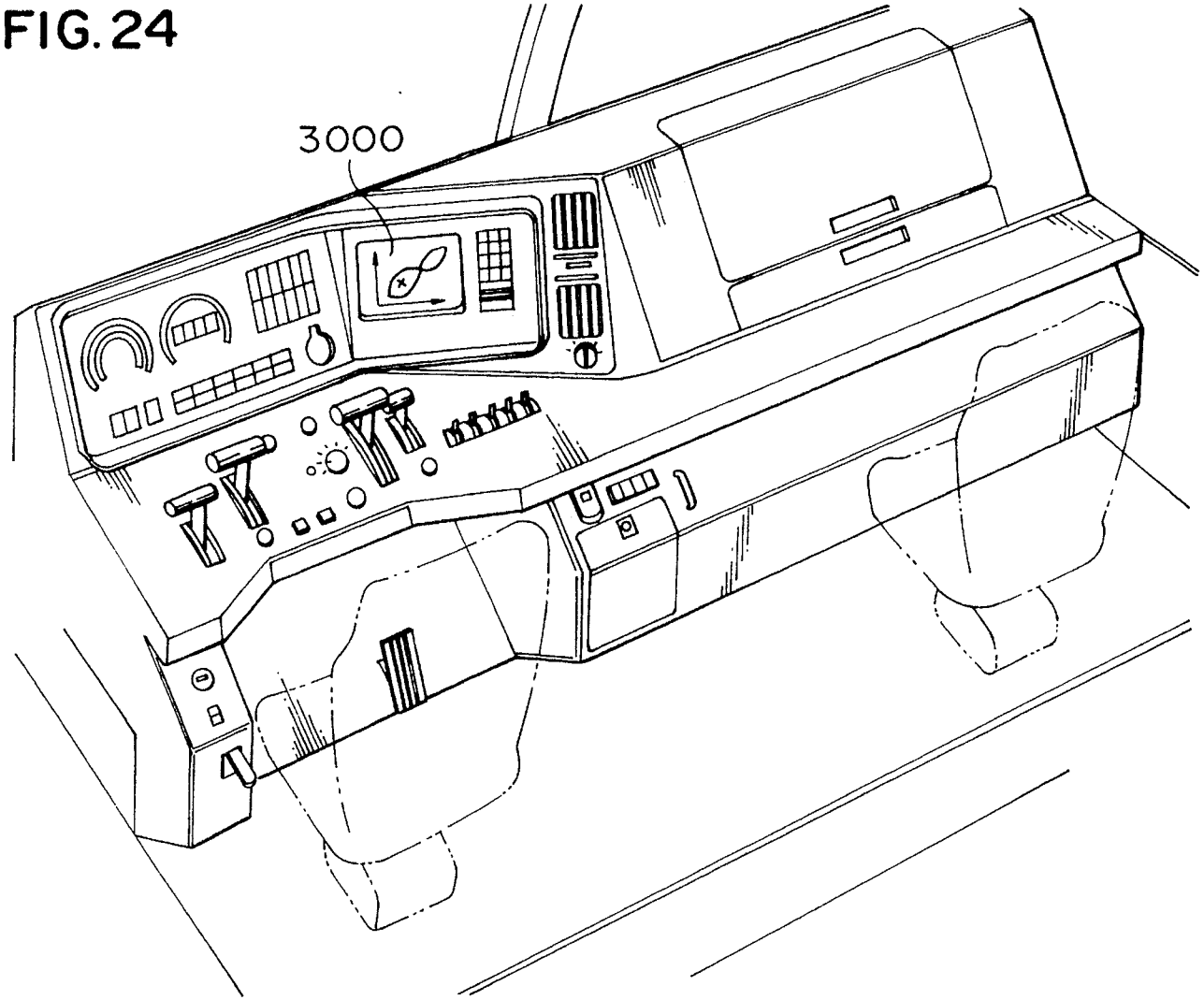
FIG. 24 is a perspective diagram of the train driver's console applied to another embodiment of this invention.
Figure 25:
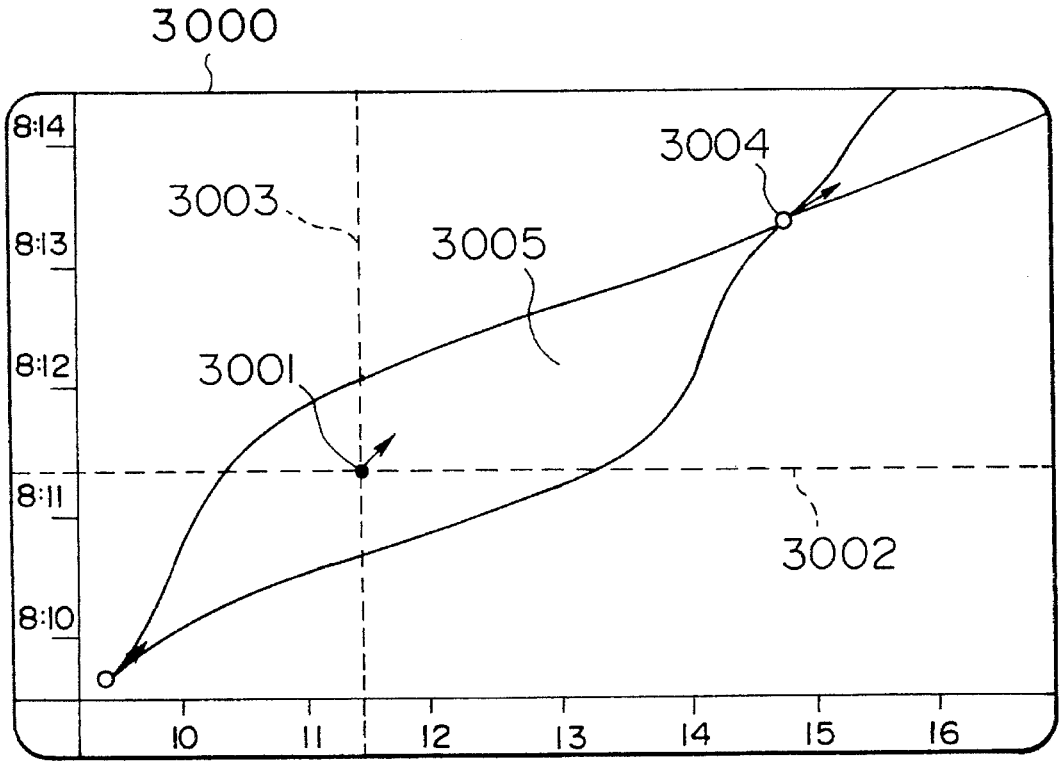
FIG. 25 and FIG. 26 are diagrams showing possible run regions displayed on the driver's console.

FIG. 24 shows the train driver's console. It includes a display screen 3000 for displaying the curves 707 and 708 shown in FIG. 10 and the current position of the train. In FIG. 25, a possible run region of the train 3005 and the current train position 3001 (that moves with the reticle of the current time 3002 and current train position 3003) are displayed, and the train driver runs the train so that the current train position is always within the region.

Figure 26:
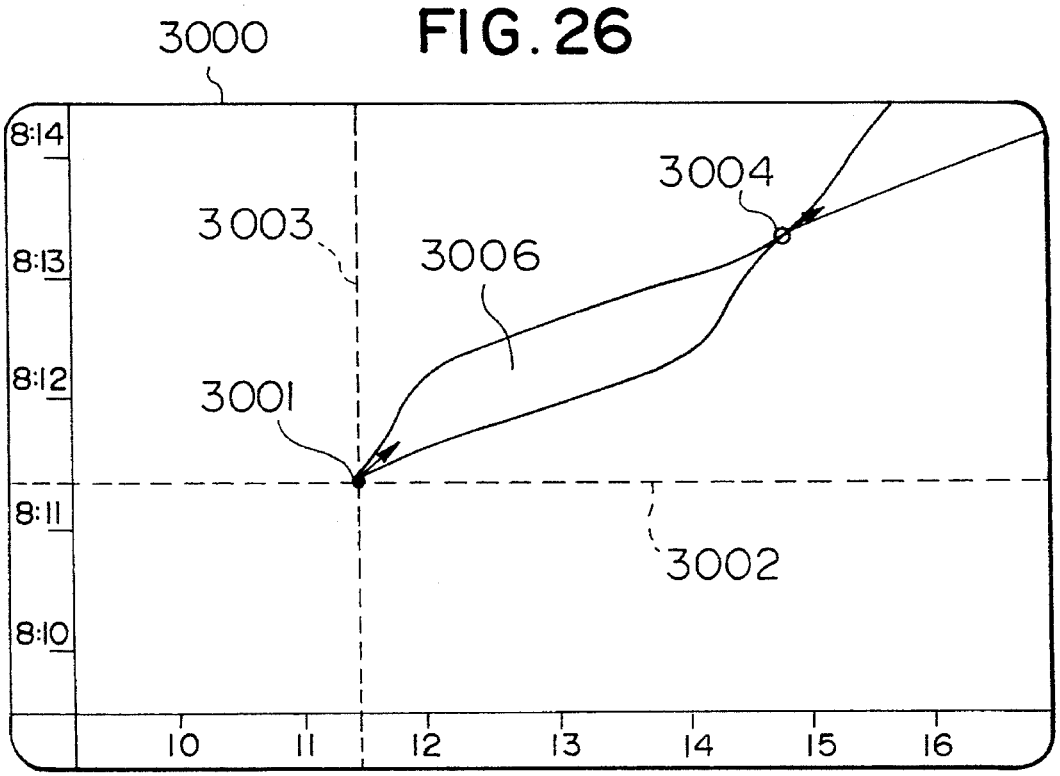

FIG. 26 is different from FIG. 25 in that a possible run region is created between the current train position, time and speed and the target. The train driver runs the train such that the region 3006 does not vanish. This embodiment is capable of accomplishing a proper train running even if the train is not equipped with the automatic train controller.

As described above, the inventive train control system is effective for minimizing the cause of delay through the issuance of the operational target to the train. For dealing with an event of delayed schedule, it is also capable of alleviating the delay of schedule through the setting of a new intermediate target within the possible run region determined from the target.

We claim:

1. A train control system comprising:

means for generating aimed target information including position, time and speed for each train in the system on the basis of each train's schedule and optimal-interspacing between all trains in the system;

means on each train for generating an operation curve based on the generated aimed target information and effecting the operation of the train utilizing the generated operation curve; and means for effecting the communication between said means for generating aimed target information and said means for generating the operation curve.

2. A train control system according to claim 1, further comprising:

means for detecting the state of the train's operation:

means for determining whether the train is capable of arriving at said aimed target; and means for altering said aimed target when it is impossible to arrive at said aimed target.

3. A train control system according to claim 1, further comprising:

means for calculating a possible run region between aimed target information on each train; and means for displaying said possible run region at a train driver's console.

4. A train control system according to claim 3, wherein:

said possible run region is defined by a region enveloped between operation curves for arriving at the position, time, speed of said aimed target from the position, time, speed of an immediately preceding aimed target through a maximum acceleration and a maximum deceleration, and between operation curves for arriving at the position, time, speed of an immediately subsequent aimed target from the position, time, speed of the aimed target through the maximum deceleration and the maximum acceleration.

5. A train control system according to claim 3, wherein:

said possible run region is defined by a region enveloped between operation curves for arriving at the position, time speed of said aimed target from the position, time, speed of an immediately preceding aimed target through a maximum acceleration, a running due to a most high speed operation curve, and a maximum deceleration, and between operation curves for arriving at the position, time, speed of an immediately subsequent aimed target from the position, time, speed of the aimed target through the maximum deceleration, the maximum acceleration, and the running due tot he most high speed operation curve.

6. A train control system according to claim 3, wherein:

said possible run region is defined by region enveloped between operation curves for arriving at the position, time, speed of said aimed target from a current position, and current time of said train through a maximum acceleration and a maximum deceleration, and between operation curves for arriving at the position, time speed of an immediately subsequent aimed target from the position, time speed of the aimed target through the maximum deceleration and maximum acceleration.

7. A train control system according to claim 3, wherein:

said possible run region is defined by a region enveloped between operation curves for arriving at the position, time, speed of said aimed target from a current position, and current time of said train through a maximum acceleration, a running due to a most high speed operation curve, and a maximum deceleration, and between the operation curves for arriving at the position, time, speed of an immediately subsequent aimed target from the position, time, speed of the aimed target through the maximum deceleration, the maximum acceleration, and the running due to the most high speed operation curve.

8. A train control system according to claim 3, further comprising:

means for displaying said possible run region and the conditions of the position and speed of said train on a train driver's console.

9. A train control system comprising:

means for generating aimed target information including position, time and speed for each train in the system on the basis of each train's operation schedule and proper interspacing between trains;

means on each train for generating an operation curve based on the generated aimed target information and effecting the operation of the train utilizing the generated operation curve; and means for effecting the communication between said means for generating aimed target information and said means for generating the operation curve;

wherein:

said means for generating aimed target information calculates possible run regions of plural trains to arrive at said aimed target;

run fault between trains is detected from said possible run regions of plural trains; and said aimed target information is renewed or added with other aimed target information to remove said run fault when said run fault was detected.

10. A train control system according to claim 9, wherein:

said possible run region is defined by a region enveloped between operation curves for arriving at the position, time, speed of said aimed target from the position, time, speed of an immediately proceeding aimed target through a maximum acceleration and a maximum deceleration, and between operation curves for arriving at the position, time, speed of an immediately subsequent aimed target from the position, time, speed of the aimed target through the maximum deceleration and the maximum acceleration.

11. A train control system according to claim 9, wherein:

said possible run region is defined by a region enveloped between operation curves for arriving at the position, time, speed of said aimed target from the position, time, speed of an immediately preceding aimed target through a maximum acceleration a running due to a most high speed operation curve, and a maximum deceleration, and between operation curves for arriving at the position, time, speed of an immediately subsequent aimed target from the position, time, speed of the aimed target through the maximum deceleration, the maximum acceleration and the running due to the most high speed operation curve.

12. A train control system according to claim 9, further comprising:

safety braking adapted to be activated in accordance with a front-running train or front railway conditions, wherein said run fault is the activation of said safety braking.

13. A train control system according to claim 12, wherein said safety braking is a brake activated under an automatic train control system.

14. A train control system, comprising:

means, remote from a plurality of trains, for generating aimed target information including position and time for a given train in the system on the basis of said given train's operation schedule and optimal interspacing between all trains in the system;

means on said given train for generating an operation curve based on the generated aimed target information;

a train controller responding to said operation curve and controlling the operation of the train; and means for communicating between said means for generating aimed target information and said means for generating the operation curve.

15. A method for controlling trains comprising:

(a) at a site remote from a plurality of trains, generating aimed target information including position and time for a given train based on that train's operation schedule and optimal interspacing between all trains in the system;

(b) communicating the generated aimed target information to said given train;

(c) said given train generating an operational region based on aimed target information, current train position, and train destination;

(d) said given train, generating an optimal operational curve with said operational region; and (e) said given train, operating in a manner consistent with said optimal operational curve.

16. A method for controlling train's according to claim 15, further comprising:

(f) communicating train status to said remote site; and (g) repeating steps a to e.

17. A train control system, comprising:

means, remote from a plurality of trains, for generating aimed target information including position and time for a given train in the system on the basis of said given train's operation schedule and optimal interspacing between all trains;

means on said given train for generating an operation curve based on the generated aimed target information;

a train controller responding to said operation curve and controlling the operation of the train; and means for communicating between said means for generating aimed target information and said means for generating the operation curve;

wherein:

said means for generating aimed target information calculates possible run regions of plural trains to arrive at said aimed target;

run fault between trains is detected from said possible run regions of plural trains; and said aimed target information is renewed or added with other aimed target information to remove said run fault when said run fault was detected.

18. A method for controlling trains comprising:

(a) at a site remote from a plurality of trains, generating aimed target information including position and time for a given train based on that train's operation schedule and optimal interspacing between all trains in the system:

(b) calculating possible run regions of plural trains to arrive at said aimed target;

(c) detecting run fault between trains from said possible run regions of plural trains;

(d) renewing or adding aimed target information with other aimed target information to remove said run fault when said run fault was detected;

(e) communicating the generated aimed target information to said given train;

(f) said given train, generating an operational region based on aimed target information, current train position, and train destination;

(g) said given train, generating an optimal operational curve with said operational region; and (h) said given train, operating in a manner consistent with said optimal operational curve.

19. A method for controlling train's according to claim 18, further comprising:

(i) communicating train status to said remote site; and (j) repeating steps a to h.

* * * * *

UNITED STATES PATENT AND TRADEMARK OFFICE

CERTIFICATE OF CORRECTION

PATENT NO. : 5,487,516

DATED : 30 January 1996

INVENTOR(S) : Satoru MURATA et al.

It is certified that error appears in the above-identified patent and that said Letters Patent is hereby corrected as shown below:

| Column | Line | |
|---|---|---|
| 1 | 39 | Change "incompliance of" to --non-compliance with--. |
| 2 | 19 | Change "unfault" to --run fault--. |
| 2 | 30 | Change "misease," to --disruption,--. |
| 4 | 37 | Change "dissolving" to --eliminating--. |
| 5 | 3 | Change "examining" to --determining--. |
| 6 | 31 | After "target" delete ",". |
| 8 | 15 | Before "longer" insert --no--. |
| 8 | 16 | Change "Misease" to --Disruption--. |
| 8 | 17 | Change "planed" to --planned--. |
| 8 | 28 | After "yard" insert --on--. |

UNITED STATES PATENT AND TRADEMARK OFFICE

CERTIFICATE OF CORRECTION

PATENT NO. : 5,487,516

DATED : 30 January 1996

INVENTOR(S) : Satoru MURATA et al.

It is certified that error appears in the above-identified patent and that said Letters Patent is hereby corrected as shown below:

| Column | Line | |
|---|---|---|
| 8 | 35 | After "(FIG. 19," insert --step--. |
| 8 | 44 | Change "dissolved" to --eliminated--. |
| 8 | 44-45 | Change "is still undissolved" to --has still not been eliminated--. |
| 8 | 46 | After "(FIG. 19," insert --step--. |
| 8 | 48 | Change "dissolved" to --eliminated--. |
| 12 | 21 | After "time" insert --,--. |
| 12 | 30 | Change "tot he" to --to the--. |
| 12 | 33 | After "by" insert --a--. |
| 14 | 13 | Change "train's" to --trains--. |
| 14 | 62 | Change "train's" to --trains--. |

Signed and Sealed this

Twenty-seventh Day of August, 1996

*Attest:*

Bruce Lehman

BRUCE LEHMAN

*Attesting Officer*

*Commissioner of Patents and Trademarks*